US009870688B2

(12) United States Patent
Tomisawa

(10) Patent No.: US 9,870,688 B2
(45) Date of Patent: Jan. 16, 2018

(54) PROTECTION SUPPORT SYSTEM, PROTECTION SUPPORT SERVER AND PROTECTION TERMINAL

(71) Applicant: Renesas Electronics Corporation, Tokyo (JP)

(72) Inventor: Satoru Tomisawa, Tokyo (JP)

(73) Assignee: Renesas Electronics Corporation, Tokyo (JP)

( * ) Notice: Subject to any disclaimer, the term of this patent is extended or adjusted under 35 U.S.C. 154(b) by 0 days.

(21) Appl. No.: 14/971,822

(22) Filed: Dec. 16, 2015

(65) Prior Publication Data

US 2016/0284188 A1 Sep. 29, 2016

(30) Foreign Application Priority Data

Mar. 26, 2015 (JP) ..... 2015-064387

(51) Int. Cl.
*G08B 21/04* (2006.01)
*G08B 21/02* (2006.01)

(52) U.S. Cl.
CPC ..... *G08B 21/04* (2013.01); *G08B 21/0222* (2013.01); *G08B 21/0227* (2013.01);
(Continued)

(58) Field of Classification Search
CPC ..... G08B 21/0222; G08B 21/0227; G08B 21/0269; G08B 21/0277; G08B 21/0283; G08B 21/04
(Continued)

(56) References Cited

U.S. PATENT DOCUMENTS 7,102,508 B2 * 9/2006 Edelstein ..... A61B 5/00 340/539.13
8,284,061 B1 * 10/2012 Dione ..... G06Q 30/0269 235/383

(Continued)

FOREIGN PATENT DOCUMENTS

JP 2016110618 A * 6/2016
WO WO 2016117817 A1 * 7/2016 ..... G01S 5/02

*Primary Examiner* — Hirdepal Singh
(74) *Attorney, Agent, or Firm* — McGinn IP Law Group, PLLC

(57) ABSTRACT

A protection support system allows for protecting efficiently a target such as an elderly person who is wandering around. In the protection support system, a protection terminal includes an identification information receiving unit that receives identification information from a transmitter and a discovery information transmitting unit that transmits discovery information including the identification information that has been received. The protection support server includes a discovery information receiving unit that receives the discovery information, a request-side information storage unit that stores request-side information in which information on the person to be protected is associated with the identification information, a disclosure range determination unit that determines a disclosure range of the request-side information, and a protection request demand transmitting unit that transmits a protection request demand including the request-side information within the disclosure range. The protection terminal includes a protection request demand receiving unit that receives the protection request demand and a protection request demand output unit that outputs the protection request demand that has been received to a requested party.

6 Claims, 23 Drawing Sheets

(52) U.S. Cl.
CPC ..... *G08B 21/0269* (2013.01); *G08B 21/0277* (2013.01); *G08B 21/0283* (2013.01)

(58) Field of Classification Search
USPC ..... 340/573
See application file for complete search history.

(56) References Cited

U.S. PATENT DOCUMENTS

| | | | | |
|---|---|---|---|---|
| 8,441,356 | B1 * | 5/2013 | Tedesco | G08B 21/0453<br>340/539.15 |
| 2011/0035231 | A1 * | 2/2011 | Firminger | G06F 19/3418<br>705/2 |
| 2015/0317356 | A1 * | 11/2015 | Deichler | G06F 17/30418<br>707/760 |
| 2016/0117904 | A1 * | 4/2016 | Song | G08B 21/0263<br>340/539.13 |
| 2016/0155310 | A1 * | 6/2016 | Joao | G01C 21/34<br>340/573.1 |

* cited by examiner

PROTECTION SUPPORT SYSTEM, PROTECTION SUPPORT SERVER AND PROTECTION TERMINAL

CROSS-REFERENCE TO RELATED APPLICATIONS

This application is based upon and claims the benefit of priority from Japanese patent application No. 2015-064387, filed on Mar. 26, 2015, the disclosure of which is incorporated herein in its entirety by reference.

BACKGROUND

The present invention relates to a protection support system, a protection support server, and a protection terminal, and can be suitably used, for example, for a protection support system, a protection support server, and a protection support terminal that support protection of a person to be protected.

Nowadays, 23% of the Japanese population are elderly people whose age is 65 or higher. It is expected that aging of the population will further proceed and it is estimated that more than 30% of the Japanese population will be elderly people in 2025. One of the major problems of elderly people is that some of them tend to wander around due to dementia, which is becoming a serious social problem as the aging of the population proceeds. A system that supports a search for the elderly people who are wandering around is thus required. As related art, Non-Patent Literature 1 is known, for example.

[Non-Patent Literature 1] Nissha Printing Co., Ltd., "We have started development of a rescue beacon to rescue a person who is wandering around!", [online], Jul. 30, 2014, [searched on Mar. 23, 2015], Internet <URL: http://smartphone-ec.net/ibeacon/526.html>

SUMMARY

In the related art such as Non-Patent Literature 1, a transmitter that transmits signals is held by an elderly person, and a server for detecting the position of the elderly person is able to search for the elderly person. However, the related art only considers the search for the elderly person and does not consider how to protect the elderly person who has been found.

Therefore, there is a problem in the related art that it is difficult to efficiently protect the target such as the elderly person who is wandering around.

The other problems of the related art and the novel characteristics of the present invention will be made apparent from the descriptions of the specification and the accompanying drawings.

According to one embodiment, a protection support system includes a protection terminal and a protection support server. The protection terminal receives identification information from a transmitter held by a person to be protected and transmits discovery information including the identification information that has been received to a protection support server.

The protection support server includes a request-side information storage unit that stores request-side information in which identification information and information on the person to be protected regarding the person to be protected are associated with each other. The protection support server receives the discovery information transmitted from the protection terminal, determines a disclosure range of the request-side information corresponding to the identification information included in the discovery information that has been received, and transmits a protection request demand including the request-side information within the disclosure range that has been determined to the protection terminal.

Further, the protection terminal receives a protection request demand including the request-side information within the disclosure range from the protection support server and outputs the protection request demand that has been received to a requested party who protects the person to be protected.

A method or a system used in place of the apparatus according to the above embodiments, a program that causes a computer to execute some or all of the processing of this apparatus, an imaging apparatus including this apparatus and the like are effective as aspects of the present invention.

According to the embodiment, it is possible to efficiently protect the target.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

Figure 1A:
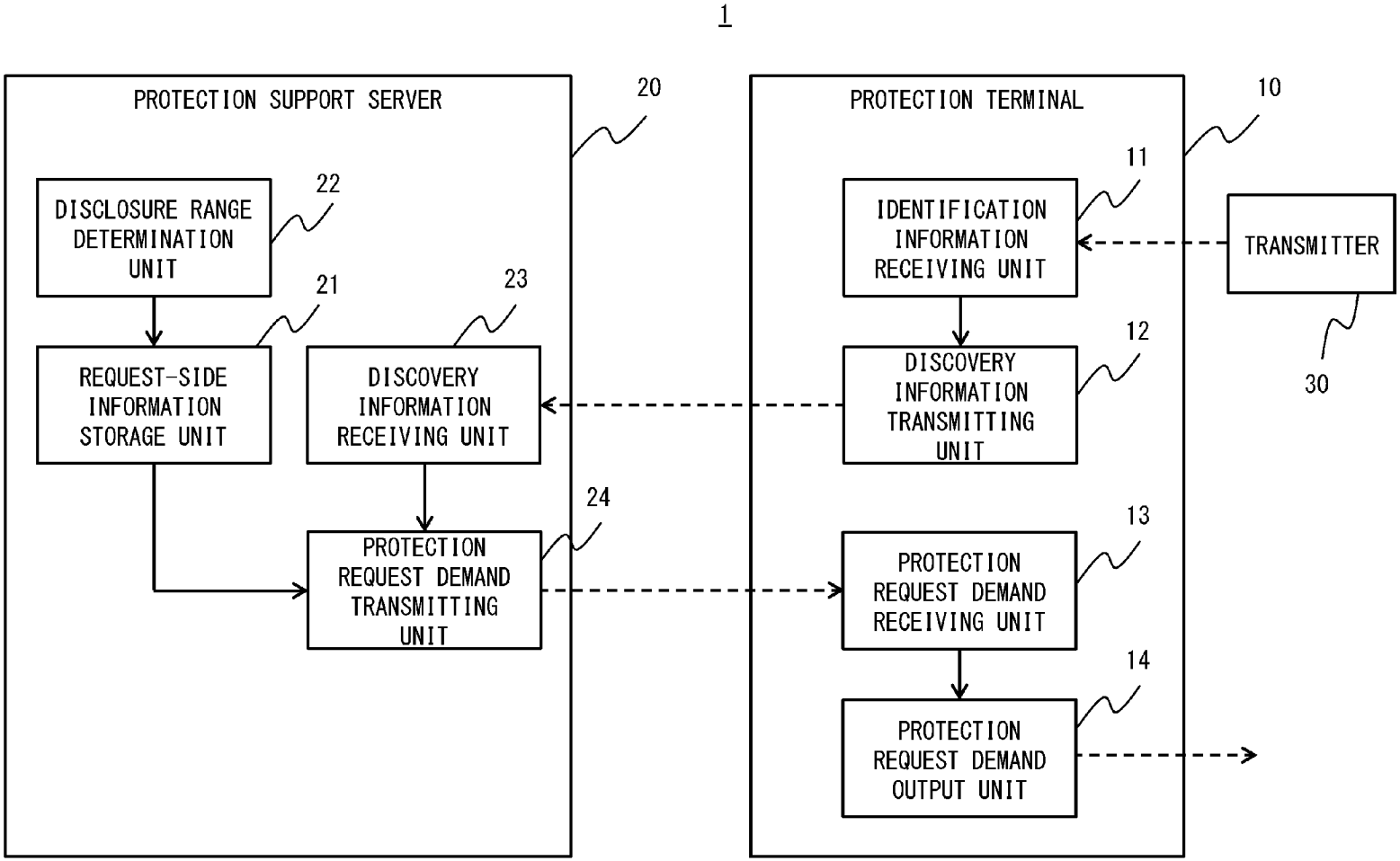
FIG. 1A is a configuration diagram schematically showing a configuration example of a protection support system according to an embodiment.

For the clarification of the description, the following description and the drawings may be omitted or simplified as appropriate. Further, each element shown in the drawings as functional blocks that perform various processing can be formed of a CPU, a memory, and other circuits in hardware and may be implemented by programs loaded in the memory in software. Those skilled in the art will therefore understand that these functional blocks may be implemented in various ways by only hardware, only software, or the combination thereof without any limitation. Throughout the drawings, the same components are denoted by the same reference symbols and overlapping descriptions will be omitted as appropriate.

Discussion on How Embodiments were Achieved

A reference example 1 that uses a GPS (Global Positioning System) and a reference example 2 that uses a PHS (Personal Handy-phone System) may be considered as examples by which a family of an elderly person who is wandering around finds out the current position of the elderly person.

In the reference example 1 that uses the GPS, a GPS device held by the elderly person in advance receives radio waves from a plurality of artificial satellites (GPS satellites) and calculates the distance between the respective artificial satellites and the GPS device to measure the current position of the elderly person. The positional information that has been measured is sent to a mobile base station and a server from the GPS device and the positional information is delivered to the family of the elderly person. After that, the family of the elderly person searches for the elderly person by reference to the positional information that has been received.

Figure 22:
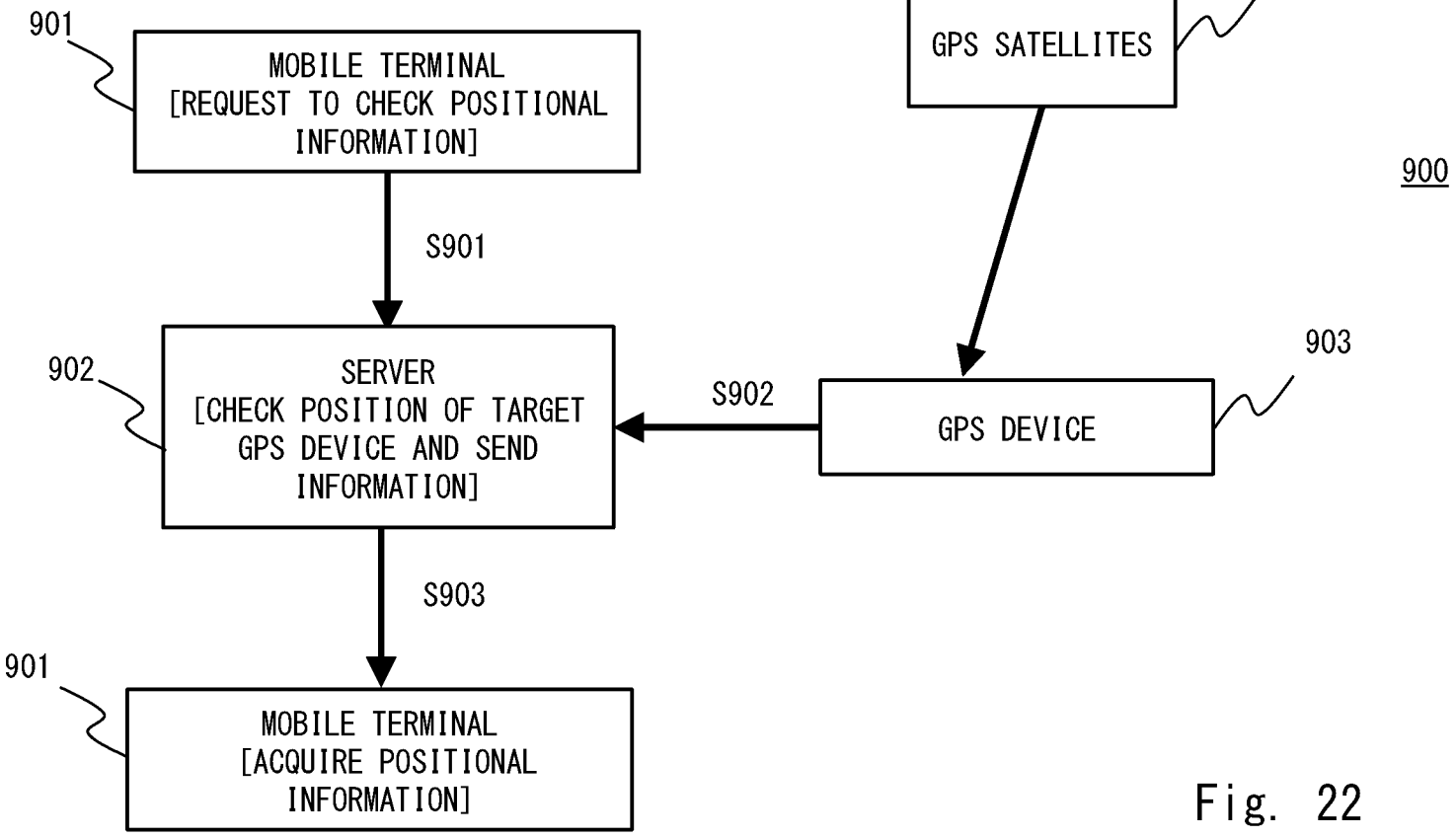
FIG. 22 is a diagram showing an operation of a system according to a reference example 1.

FIG. 22 shows an operation example of the system according to the reference example 1 that uses the GPS. As shown in FIG. 22, a system 900 according to the reference example 1 includes a mobile terminal 901, a server 902, and a GPS device 903. The elderly person holds the GPS device 903 and the family of the elderly person operates the mobile terminal 901.

First, the mobile terminal 901 requests the server 902 to check the positional information of the GPS device 903 (S901). Then the server 902 searches for the positional information of the desired GPS device 903. The GPS device 903 transmits signals measured by radio waves from GPS satellites 904 to the server 902 and the server 902 specifies the position of the GPS device 903 according to the signals received from the GPS device 903 (S902). The server 902 provides the positional information that has been specified by itself for the mobile terminal 901 that has sent the request (S903).

In the reference example 2 that uses the PHS, a PHS terminal held by the elderly person in advance receives radio waves (base station data) from a plurality of PHS base stations and calculates the current position of the elderly person based on the base station data. The positional information that has been measured is sent to the PHS base stations and the server from the PHS terminal and is then sent to the family of the elderly person. After that, the family of the elderly person searches for the elderly person by reference to the positional information that has been received.

Figure 23:
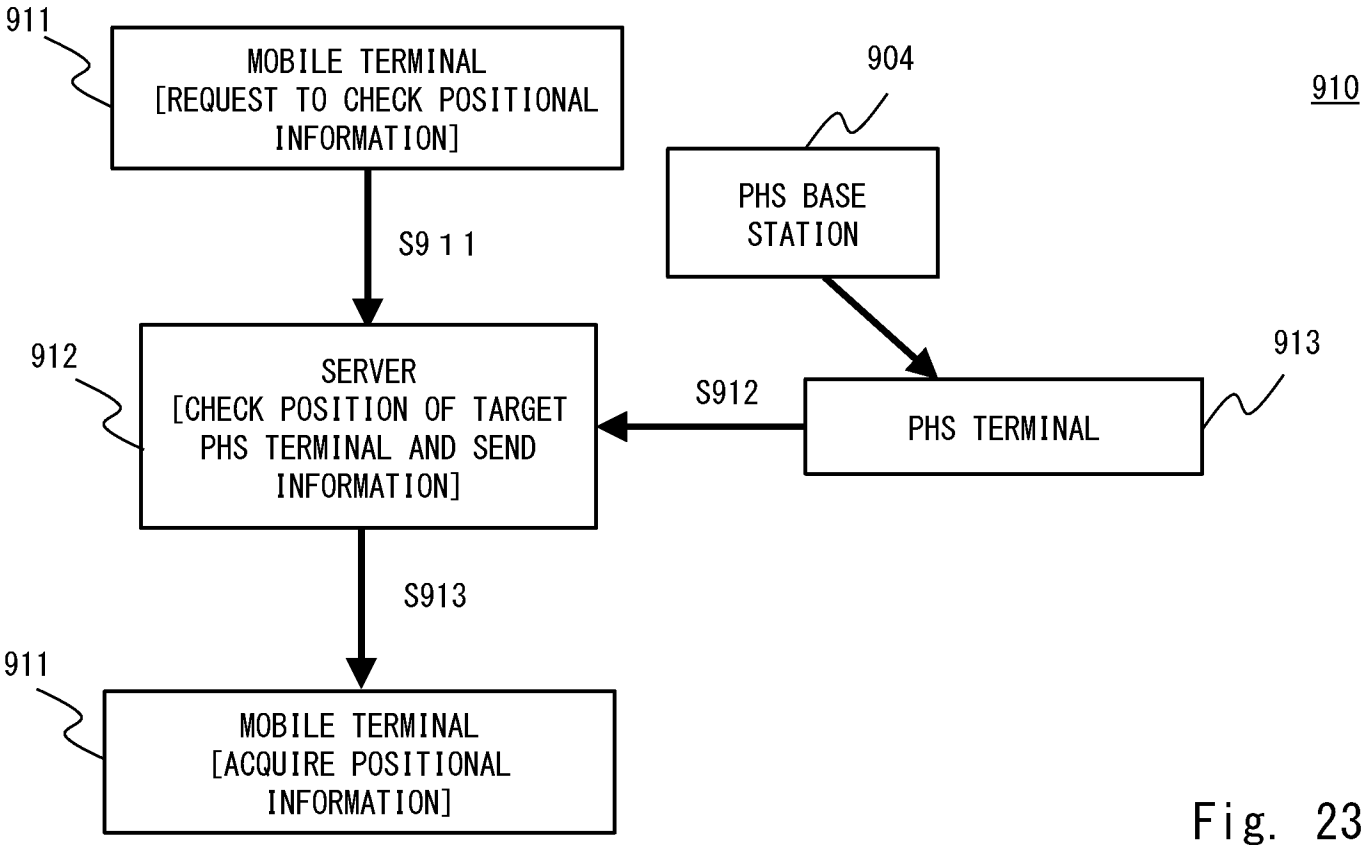
FIG. 23 is a diagram showing an operation of a system according to a reference example 2.

FIG. 23 shows an operation example of the system according to the reference example 2 that uses the PHS. As shown in FIG. 23, a system 910 according to the reference example 2 includes a mobile terminal 911, a server 912, and a PHS terminal 913. The elderly person holds the PHS terminal 913 and the family of the elderly person operates the mobile terminal 911.

The operations of the reference example 2 are similar to those of the reference example 1 except for the detection of the position of the elderly person. That is, the mobile terminal 911 requests the server 912 to check the positional information of the PHS terminal 913 (S911), the PHS terminal 913 transmits signals measured by radio waves from the PHS base station 914 to the server 912, and the server 912 specifies the position of the PHS terminal 913 (S912) from the signals received from the PHS terminal 913 and provides the positional information that has been specified by the server 912 for the mobile terminal 911 (S913).

There are however the following problems in the reference examples 1 and 2. First, the elderly person may forget to bring the GPS device/PHS terminal. It may be possible, for example, to let the elderly person hold a plurality of terminals. However, the price of each terminal is several thousand yen, the size of each terminal is as large as about several tens of $cm^3$, and the battery life of each terminal is only about ten days. It takes so much effort to charge the plurality of terminals.

Regarding the protection of the elderly person, in the reference examples 1 and 2, it takes time and requires a lot of processes to protect the elderly person because after the mobile terminal acquires the positional information of the elderly person, the family of the elderly person has to go to the place where the elderly person is to protect him/her. When the family of the elderly person notices the absence of the elderly person, the family of the elderly person hopes to minimize the probability that the elderly person will be involved in trouble or causes trouble and thus the elderly person needs to be quickly protected.

Further, even when the mobile terminal acquires the positional information of the elderly person, the family of the elderly person may not be ready to go to search for the elderly person. For example, it may be possible to use a service for protecting the elderly person in place of the family based on the positional information of the elderly person. However, not everyone can use such a service since the fee is quite high (about 10,000 yen for each use of the service) and there are concerns about there being a shortage of people who can protect the elderly people as the number of elderly people will further increase in the future. Another method in which the family of the elderly person asks a volunteer to protect the elderly person based on the positional information of the elderly person may be possible. However, according to such a method, if personal information (privacy information) of the elderly person or the requester is simply provided for the volunteer or the like, security cannot be protected and privacy might be invaded.

Outline of Embodiment

Figure 1B:
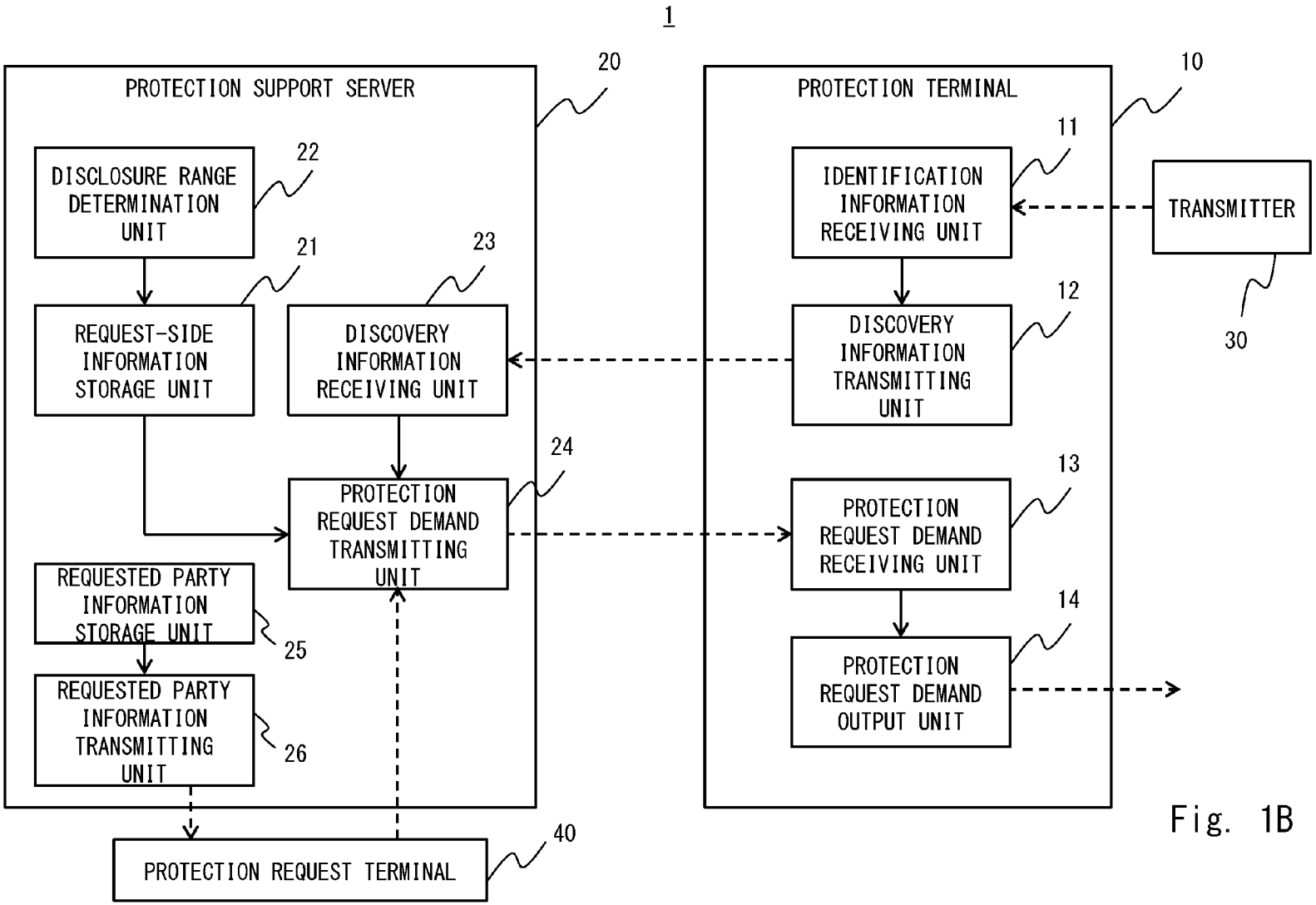
FIG. 1B is a configuration diagram schematically showing a configuration example of the protection support system according to the embodiment.

FIGS. 1A and 1B each show an example of the outline of a protection support system according to an embodiment. As shown in FIG. 1A, a protection support system 1 according to the embodiment includes a protection terminal 10 and a protection support server 20. The protection support server 20 is a server that supports protection of a person to be protected and the protection terminal 10 is a terminal of a requested party (person who actually protects the elderly person) who accepts the request for protecting the person to be protected from the protection support server 20.

The protection terminal 10 includes an identification information receiving unit 11, a discovery information transmitting unit 12, a protection request demand receiving unit 13, and a protection request demand output unit 14. The identification information receiving unit 11 receives identification information from a transmitter 30 held by the person to be protected. The discovery information transmitting unit 12 transmits discovery information including the identification information received by the identification information receiving unit 11 to the protection support server 20. The person to be protected is, for example, an elderly person who tends to wander around due to dementia or the like, a lost child, or a lost pet.

The protection support server 20 includes a request-side information storage unit 21, a disclosure range determination unit 22, a discovery information receiving unit 23, and a protection request demand transmitting unit 24. The discovery information receiving unit 23 receives the discovery information transmitted from the protection terminal 10. The request-side information storage unit 21 stores request-side information in which the information on the person to be protected and the identification information regarding the person to be protected are associated with each other. The disclosure range determination unit 22 determines the disclosure range of the request-side information corresponding to the identification information included in the discovery information that has been received. The protection request demand transmitting unit 24 transmits a protection request demand including the request-side information within the disclosure range that has been determined to the protection terminal 10.

Further, in the protection terminal 10, the protection request demand receiving unit 13 receives the protection request demand including the request-side information within the disclosure range from the protection support server 20. The protection request demand output unit 14 outputs the protection request demand received from the protection support server 20 to the requested party who protects the person to be protected.

Further, in the example shown in FIG. 1B, the protection support system 1 includes a protection request terminal 40. The protection request terminal 40 is a terminal of a person who asks for the protection of the person to be protected. The protection support server 20 further includes a requested party information storage unit 25 and a requested party information transmitting unit 26. The requested party information storage unit 25 stores requested party information regarding the requested party. The requested party information transmitting unit 26 refers to the requested party information storage unit 25 and transmits the requested party information corresponding to the protection terminal 10 that has transmitted the discovery information to the protection request terminal 40. Upon receiving the request from the protection request terminal 40 according to the requested party information transmitted from the requested party information transmitting unit 26, the protection request demand transmitting unit 24 transmits the protection request demand to the protection terminal 10.

In this embodiment, the transmitter 30 held by the person to be protected may have only a function of transmitting short-range wireless signals. Therefore, the transmitter 30 may have a simple configuration including a chip antenna, a coin battery, a microcomputer, and a high-frequency transceiver. In this case, the price and the size of the transmitter 30 can be reduced and power consumption can be decreased in the transmitter 30. It is possible to omit the process of charging and to let the elderly person have a plurality of devices.

Bluetooth (registered trademark) (IEEE802.15.1) may be employed, for example, as a short-range wireless communication standard of the transmitter 30. Bluetooth is a short-range communication standard used in typical smartphones. In Bluetooth LE (BLE) that has been recently standardized, a method of performing connectionless data broadcasting is employed to save power. By employing Bluetooth LE, in particular, a large amount of power can be saved. One of the service that uses connectionless broadcasting of Bluetooth LE is an iBeacon (registered trademark) service that provides positional information in a short-distance region. In the embodiments, identification information is broadcasted to peripheral terminals using the iBeacon packet (iBeacon) for the iBeacon service.

Figure 2:
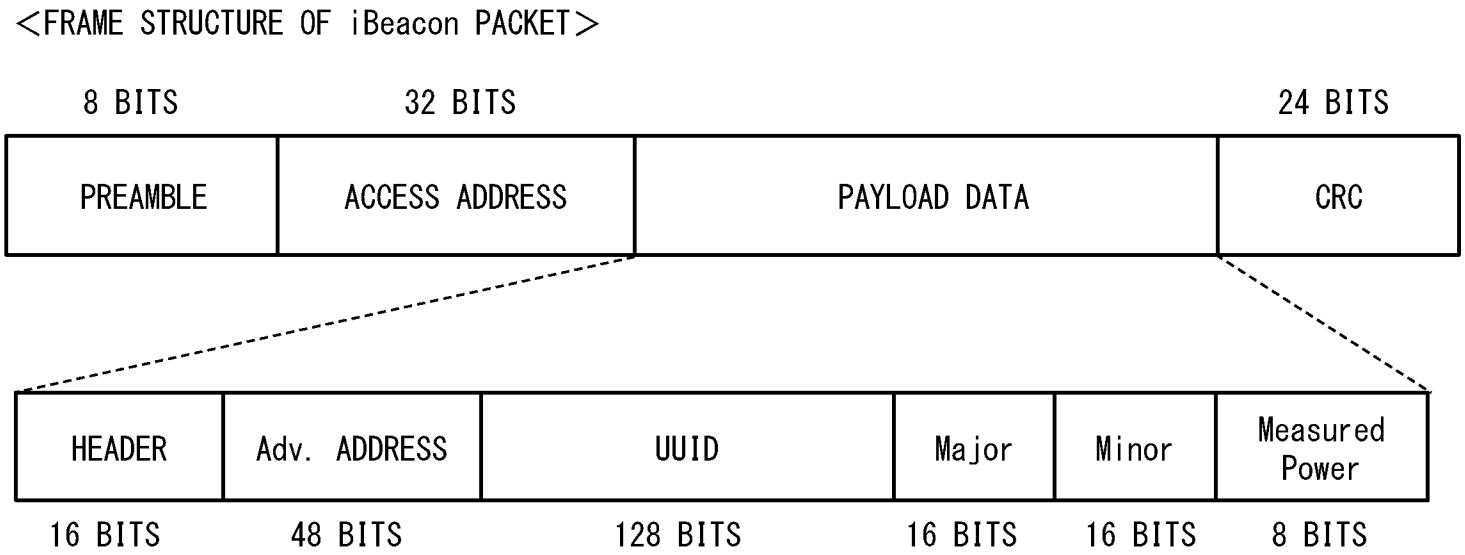
FIG. 2 is a configuration diagram showing a configuration of an iBeacon packet used in the embodiment.

FIG. 2 shows a configuration of the iBeacon packet used in the iBeacon service. The iBeacon packet is a connectionless advertising packet that performs connectionless distribution of data required to provide services. As shown in FIG. 2, the iBeacon packet includes a preamble, an access address, payload data, and a CRC (Cyclic Redundancy Check). Further, the payload data in the iBeacon packet includes a header, an Adv address (Advertising address), UUID (128 bits), Major (16 bits), Minor (16 bits), and Measured Power (8 bits).

A transmitter (beacon device) that transmits information sets contents of the service and the identification information for UUID, Major, and Minor in the payload data, sets a transmission level value of a position at a distance of 1 m from the transmitter (beacon device) used to calculate the distance for the Measured Power, and transmits the iBeacon packet thus configured.

A protection terminal (receiver) that receives information is able to identify the contents of the service and the identification information by UUID, Major, and Minor and provide services according to the distance detected by the Measured Power. For example, when the beacon device sets the Measured Power to be −50 dBm and the reception level in the receiver is −50 dBm or larger, it can be detected that the distance between the beacon device and the receiver is within 1 m. Further, since the signal level attenuates by −20 dB for an increment of about 10 min the distance when the frequency in vacuum freq. is 2.4 GHz, the distance between the beacon device and the receiver can be detected from the difference between the "configuration value −50 dBm" and "the reception level in the receiver".

In the embodiments, when there is a person to be protected who holds the transmitter near the person having the protection terminal (volunteer or the like), the requester having the protection request terminal is able to exchange information with the person having the protection terminal via the protection support server and to understand the status of the person to be protected and request the protection. Further, the person having the protection terminal is able to notice that the person to be protected has gotten lost or is wandering around before the requester notices the same and to contact the requester having the protection request terminal via the protection support server from the protection terminal. It is therefore possible to quickly find and protect the person to be protected.

Further, since only the request-side information within the disclosure range is reported to the protection terminal, it is possible to protect privacy of the person to be protected and the requester and to ensure security.

First Embodiment

Figure 3:
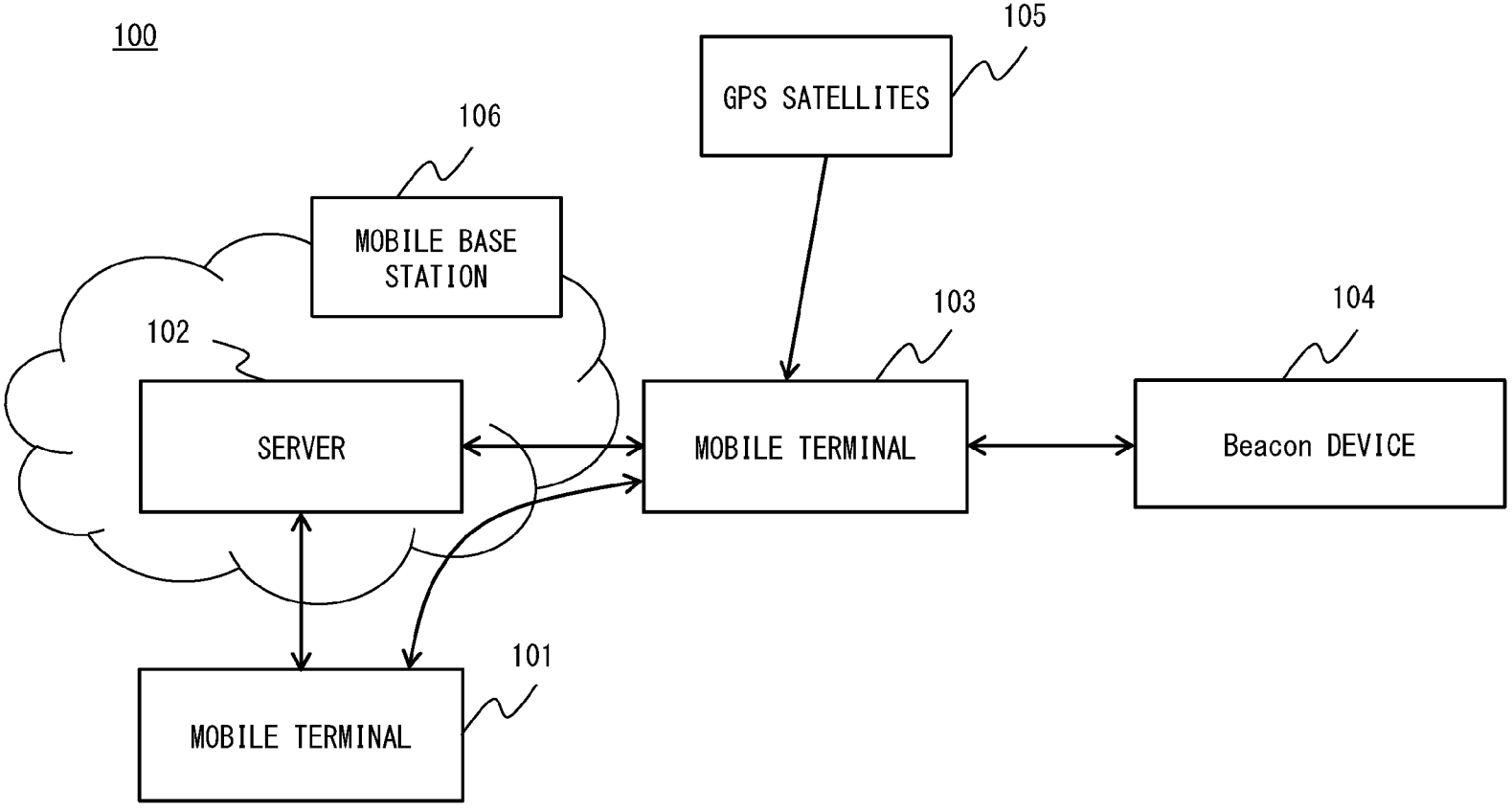
FIG. 3 is a configuration diagram showing a configuration example of a protection support system according to a first embodiment.

Hereinafter, with reference to the drawings, a first embodiment will be described. FIG. 3 shows a configuration of a protection support system according to this embodiment. As shown in FIG. 3, a protection support system 100 according to this embodiment mainly includes a mobile terminal 101, a server 102, a mobile terminal 103, and a beacon device 104.

The beacon device 104 is a transmitter held by the elderly person to be protected and transmitting the identification information by the short-range wireless communication.

The mobile terminal 103 is a protection terminal that is held and operated by the requested party such as the volunteer who receives the request for the protection. The mobile terminal 103 detects the position based on radio waves from GPS satellites 105 and receives the identification information from the beacon device 104. The mobile terminal 103 transmits the identification information, the positional information and the like to the server 102 via a mobile base station 106 and communicates with the mobile terminal 101 via the mobile base station 106.

The server 102 is a protection support server that supports protection of the elderly person. The server 102 notifies the mobile terminal 101 that the elderly person has been found according to the identification information and the positional information received from the mobile terminal 103 and asks the mobile terminal 103 to perform protection according to the protection request demand from the mobile terminal 101. The server 102 provides information on the elderly person, the requester, or the volunteer within the disclosure range that has been set for the mobile terminals 101 and 103.

The mobile terminal 101 is a protection request terminal that is held and operated by the person such as the family of the elderly person who asks for the protection of the elderly person. The mobile terminal 101 asks for the protection of the elderly person via the server 102 based on the information on the volunteer and the position where the elderly person has been found obtained from the server 102 and communicates with the mobile terminal 103 via the mobile base station 106.

Figure 4:
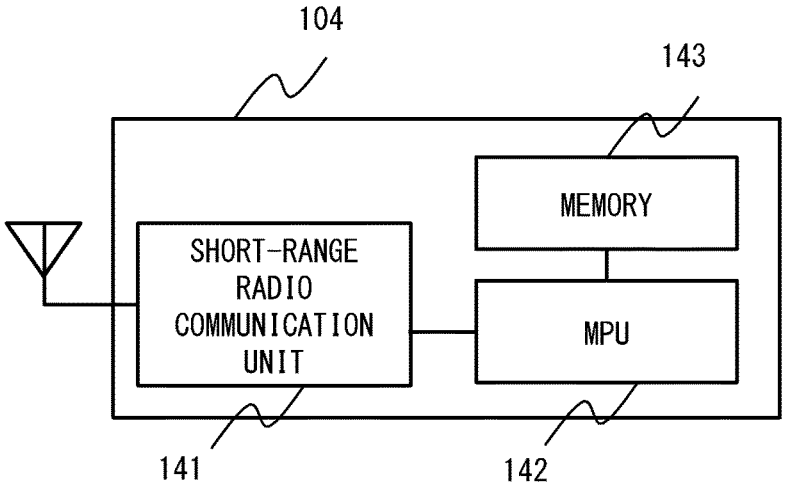
FIG. 4 is a hardware block diagram showing a configuration example of a beacon device according to the first embodiment.

FIG. 4 shows a hardware configuration example of the beacon device 104 according to this embodiment. The beacon device (short-range wireless device) 104 is a radio transmitting apparatus that transmits by radio information to the mobile terminal 103 in compliance with Bluetooth. The beacon device 104 is, for example, an iBeacon device that periodically transmits iBeacon packets. The beacon device 104 is in compliance with a wireless standard such as the iBeacon packets in which there are restrictions on the transmission packet length especially for a low power consumption. The beacon device 104 is not limited to the one that is in compliance with Bluetooth and may be another radio device.

As shown in FIG. 4, the beacon device 104 includes a short-range (BLE: Bluetooth Low Energy) radio communication unit 141, an MPU (system controller) 142, and a memory 143.

The MPU (Micro Processor Unit) 142 is a controller that executes control processing required in the beacon device 104. The memory 143 is a storage unit that stores data and programs required for the processing in the MPU 142. The MPU 142 executes processing based on the data and the programs stored in the memory 143.

The short-range radio communication unit 141 is a radio transmitting unit that performs radio transmission in compliance with the Bluetooth standard. The short-range radio communication unit 141 transmits the iBeacon packet (beacon packet) according to an instruction from the MPU 142. While the iBeacon packet is one example of the beacon packet, this embodiment may be applied to a packet other than the beacon packet. For example, another advertisement packet that periodically broadcasts predetermined information may be used.

Figure 5:
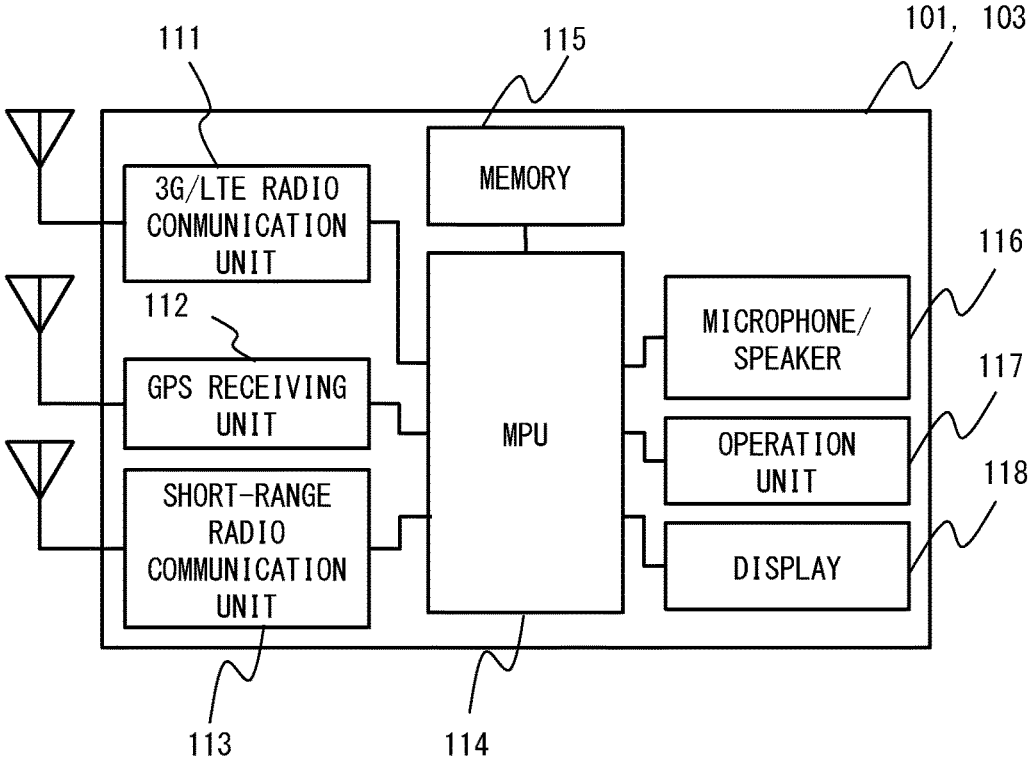
FIG. 5 is a hardware block diagram showing a configuration example of a mobile terminal according to the first embodiment.

FIG. 5 shows a hardware configuration example of mobile terminals 101 and 103 according to this embodiment. The mobile terminals 101 and 103 have the same configuration and are, for example, smartphones, mobile telephones, or tablet terminals. The mobile terminal 103 is preferably a portable terminal such as a smartphone so that it is possible to find and protect the elderly person or the like who is wandering around. The mobile terminal 101 is not limited to a portable terminal and may be a computer such as a personal computer since it is sufficient that it can ask for the protection. The mobile terminals 101 and 103 (in particular, the mobile terminal 103) are iBeacon receivers (radio receivers) that receive iBeacon packets that have been periodically transmitted. Each of the mobile terminals 101 and 103 is also a client device that operates as a client to the server 102.

As shown in FIG. 5, the mobile terminals 101 and 103 includes a 3G/LTE radio communication unit 111, a GPS receiving unit 112, a short-range (BLE) radio communication unit 113, an MPU (system controller) 114, a memory 115, a microphone/speaker 116, an operation unit 117, and a display 118.

The MPU (Micro Processor Unit) 114 is a controller that executes control processing required for the mobile terminals 101 and 103. The memory 115 is a storage unit that stores data or programs required for the processing of the MPU 114. The MPU 114 executes processing based on the data or the programs stored in the memory 115.

The short-range radio communication unit 113 is a radio receiving unit that performs radio reception in compliance with the Bluetooth standard. The short-range radio communication unit 113 receives iBeacon packets (beacon packets) transmitted from the beacon device 104.

The 3G/LTE radio communication unit 111 performs radio communications via the mobile base station 106 according to the 3G (3rd Generation) or LTE (Long Term Evolution) standard. The 3G/LTE radio communication unit 111 may employ a communication method other than the 3G or the LTE (e.g., 4G, 5G, wireless LAN). The 3G/LTE radio communication unit 111 communicates with the server 102 via the mobile base station 106 and further performs communications between the mobile terminals 101 and 103.

The GPS receiving unit 112 receives radio waves from the GPS satellites 105 and detects the current position based on the radio waves received from the GPS satellites 105. The microphone/speaker 116, the operation unit 117, and the display 118 are input/output units to/from the user. The microphone/speaker 116 inputs or outputs speech or the like during a call. The operation unit 117 is a touch panel, an operation button or the like and accepts the operation from the user. The display 118 is a liquid crystal display or the like and displays various types of information to the user by a GUI (Graphical User Interface) or the like.

Figure 6:
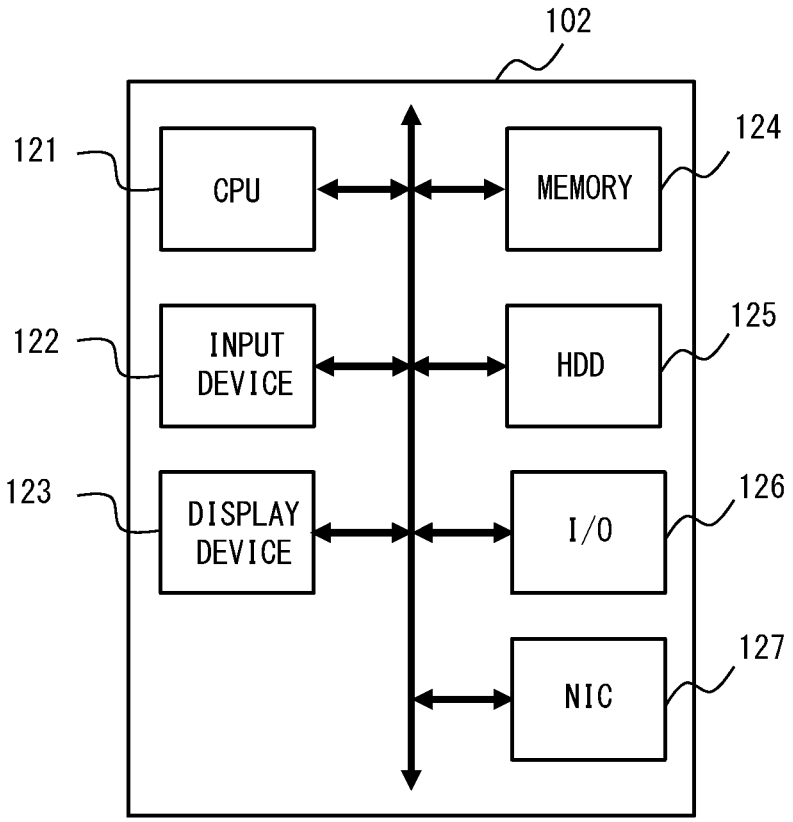
FIG. 6 is a hardware block diagram showing a configuration example of a server according to the first embodiment.

FIG. 6 shows an example of the hardware configuration to achieve the server 102. The server 102 is a computer device such as a personal computer or a work station that operates as a management apparatus. The server 102 may not be a single computer and may be composed of a plurality of computers.

As shown in FIG. 6, the server 102 is a general computer device and includes a central processing unit (CPU) 121 and a memory 124.

The CPU 121 and the memory 124 are connected to a hard disc device (HDD) 125 as an auxiliary storage device via a bus. The server 102 may include, for example, as a user interface, an input device 122 such as a pointing device (mouse, joystick or the like) or a keyboard to allow the user to input information and a display device 123 such as a liquid crystal display to present the GUI or the like to the user.

The storage medium such as the HDD 125 gives an instruction to the CPU 121 or the like in collaboration with the operating system and stores a program for implementing the function of the server 102. This program is loaded to the memory 124 and is executed by the CPU 121.

Further, the server 102 includes an input/output interface (I/O) 126 and an NIC (Network Interface Card) 127 to connect to external devices. For example, the server 102 includes an Ethernet (registered trademark) card or the like as the NIC 127 to connect to a network (Internet or the like) including the mobile base station.

Figure 7:
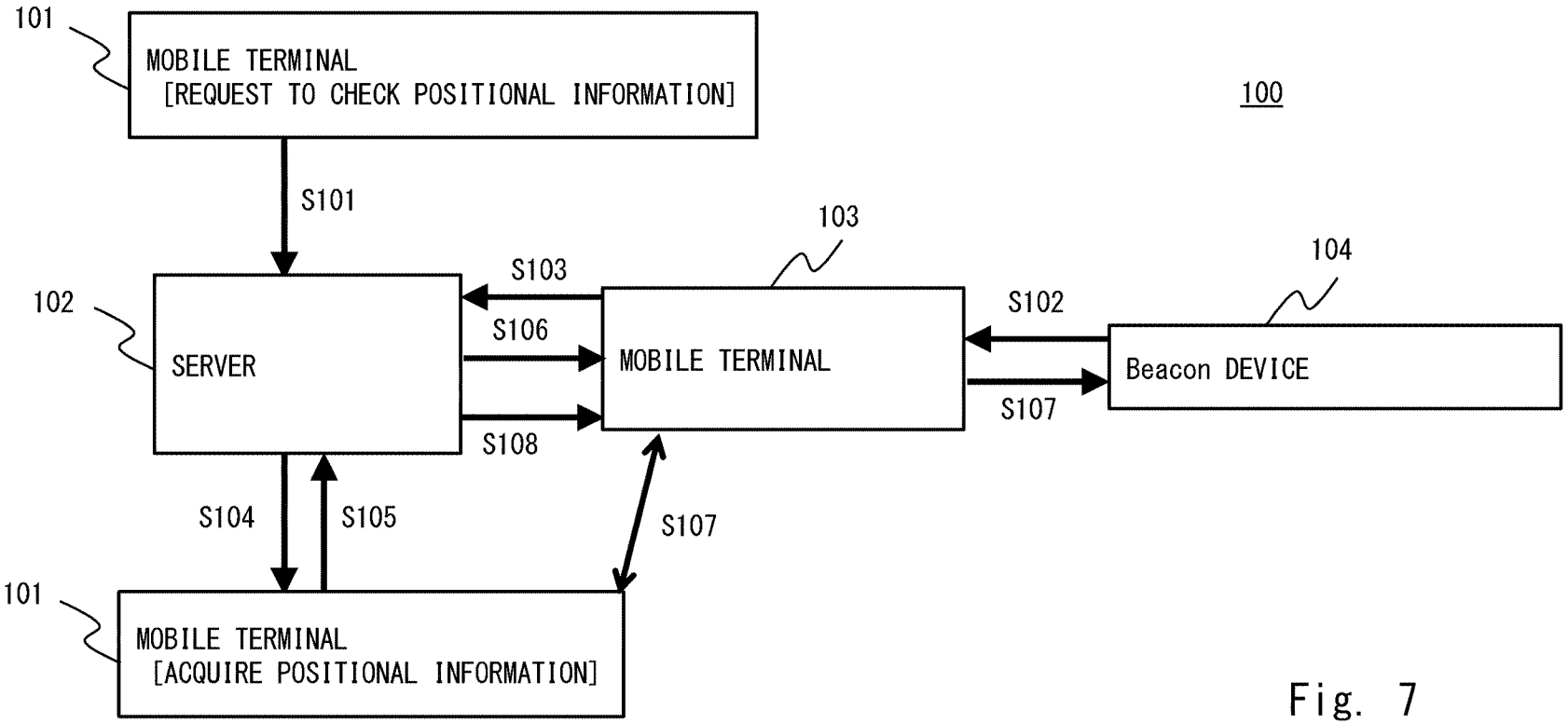
FIG. 7 is a diagram showing an outline of an operation of the protection support system according to the first embodiment.

FIG. 7 shows an outline of the operation of the protection support system according to this embodiment. The elderly person (person to be protected) holds the beacon device 104, the family of the elderly person (requester) operates the mobile terminal 101, and the volunteer (an information provider or a person who actually protects the elderly person) operates the mobile terminal 103.

First, the mobile terminal 101 asks the server 102 to check the positional information of the beacon device 104 (S101). Then the server 102 searches for the positional information of the desired beacon device 104. The beacon device 104 transmits the identification information at regular time intervals and transmits the identification information to the neighboring (about 10 m) mobile terminal 103 (S102). The mobile terminal 103 measures the position by radio waves from the GPS satellites, and when it receives the identification information from the beacon device 104 held by the elderly person located nearby, it transmits the identification information received by the application which is being activated and the positional information that has been measured to the server 102 (S103).

Upon receiving the identification information and the positional information from the mobile terminal 103, the server 102 determines the positional information of the mobile terminal 103 from the integrity of the identification information registered in a database in advance, and provides the positional information of the mobile terminal 103 for the mobile terminal 101 (S104). Upon receiving the positional information of the mobile terminal 103 from the server 102, the mobile terminal 101 asks the server 102 to protect the elderly person or check the status of the elderly person or asks the server 102 to directly contact the mobile terminal 101 (S105).

The server 102 sends the request from the mobile terminal 101 to the mobile terminal 103 (S106). When the mobile terminal 103 approves the request from the server 102, the mobile terminal 103 directly contacts (chats with) the mobile terminal 101, and protection (volunteer activities) of the elderly person having the beacon device 104 is executed (S107). After the volunteer activities are completed, the server 102 transmits a coupon or a log indicating the welfare activity history to the mobile terminal 103 (S108).

Further, as the volunteer, who is the third party, acquires information regarding the elderly person or the requester from the server 102, the disclosure range of the information that can be obtained may be set from the viewpoint of security as reflected in the opinion of the family of the elderly person. Further, by storing the activities of the third party as a log at the end of the protection activities and allowing other users to freely browse information of the activity history for each user, the family of the elderly person and the person who protects the elderly person can use this information to determine whether they can trust in each other.

Figure 8:
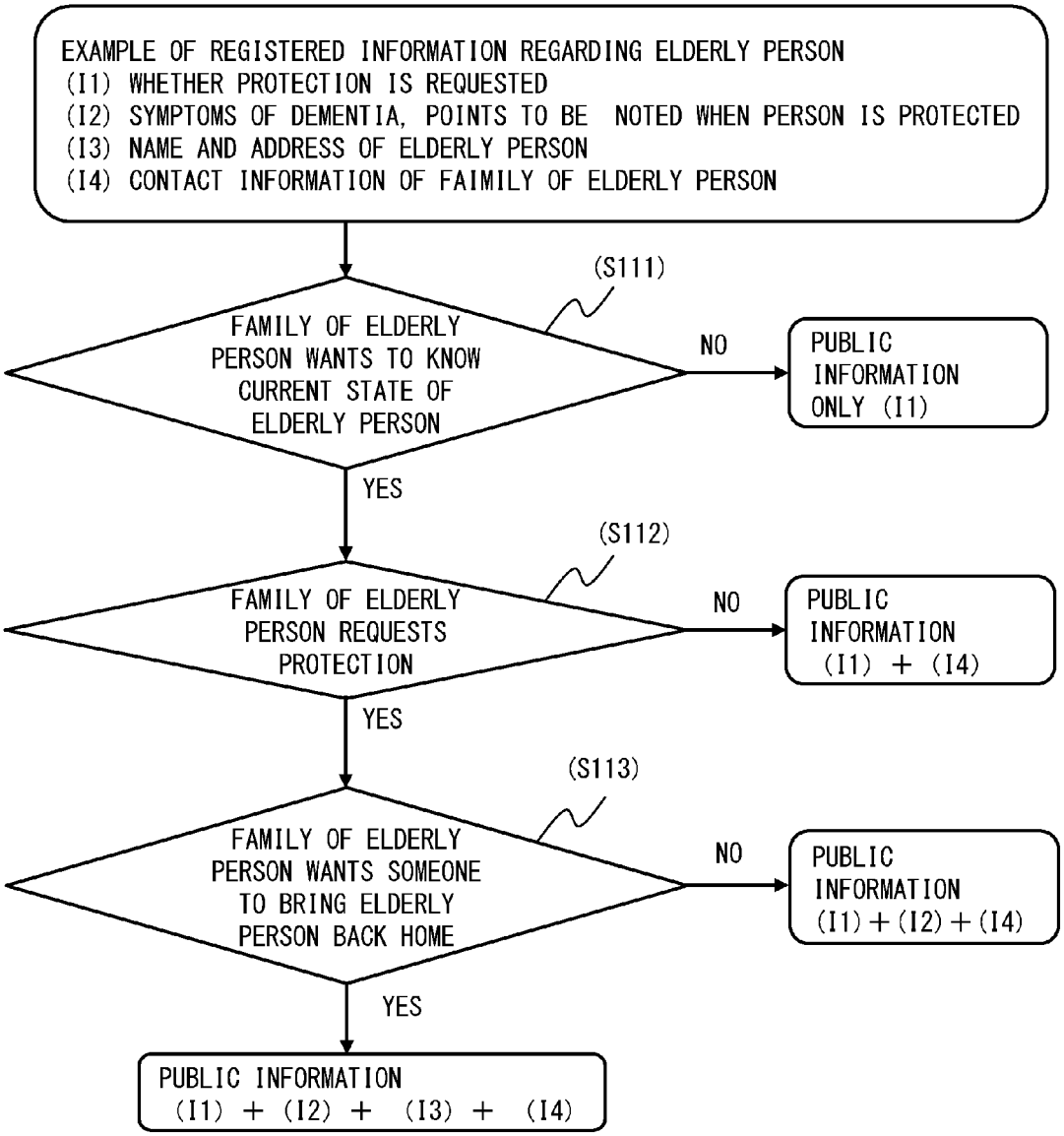
FIG. 8 is a diagram showing an outline of an operation of the protection support system according to the first embodiment.

The determination and the configuration of the disclosure range of the information may be performed by the mobile terminal 101 or 103 that registers information or may be performed by the server 102 that provides information. For example, the disclosure range (disclosure condition) is set in the information registered by the mobile terminal 101 or 103 in the server 102 and the server 102 (disclosure range determination unit such as a request information processing unit or a volunteer information processing unit) determines whether to disclose the information according to the disclosure range (disclosure condition) that has been set and provides only the information that can be disclosed for the counterpart mobile terminal 101 or 103. It is therefore possible to protect privacy of the request side and the requested side. In the example shown in FIG. 8, the server 102 stores public information I1 to I4 as registration information regarding the elderly person who has the beacon device 104. The public information I1 to I4 have disclosure ranges (disclosure conditions) different from one another and the disclosure conditions such as S111 to S113 are set. For example, the information which is the determination standard of S111 to S113 is registered from the mobile terminal 101 (specified by the requester) and the disclosure range is determined according to the contents requested from the mobile terminal 101. By determining the disclosure range (information to be disclosed) according to the requested contents, only the necessary information can be disclosed, and it is possible to further protect privacy.

The public information I1 "whether protection is requested" is set to be always disclosed (even when the family of the elderly person is not searching for the elderly person). The server 102 determines whether the family of the elderly person wants to know the current state of the elderly person (whether the family is searching for the elderly person) (S111). When the family of the elderly person does not want to know the current state of the elderly person (does not search for the elderly person), the server 102 discloses only the public information I1 to the mobile terminal 103.

The public information I4 "contact information of the family of the person to be protected" is set to be disclosed when the family of the elderly person asks to search for the elderly person. In addition to S111, the server 102 further determines whether the family of the elderly person requests the protection (S112). When the family of the elderly person wants to know the current state of the elderly person (searches for the elderly person) and the family of the elderly person does not request the protection, the server 102 discloses the public information I1+I4.

The public information I2 "symptoms of dementia, points to be noted when the person is protected" is set to be disclosed when the family of the elderly person asks to search for and protect the elderly person. In addition to S111 and S112, the server 102 determines whether the family of the elderly person wants the volunteer or the like to bring the elderly person back home (S113). When the family of the elderly person wants to know the current state of the elderly person (the family is searching for the elderly person), the family of the elderly person requests the protection, and the family of the elderly person does not want the volunteer or the like to bring the elderly person back home, the server 102 discloses the public information I1+I2+I4.

The public information I3 "the name and the address of the elderly person" is set to be disclosed when the family of the elderly person wants the volunteer or the like to bring the elderly person back home. When the family of the elderly person wants to know the current state of the elderly person (the family is searching for the elderly person), the family of the elderly person requests the protection, and the family of the elderly person wants the volunteer or the like to bring the elderly person back home, the server 102 discloses the public information I1+I2+I3+I4.

Figure 9:
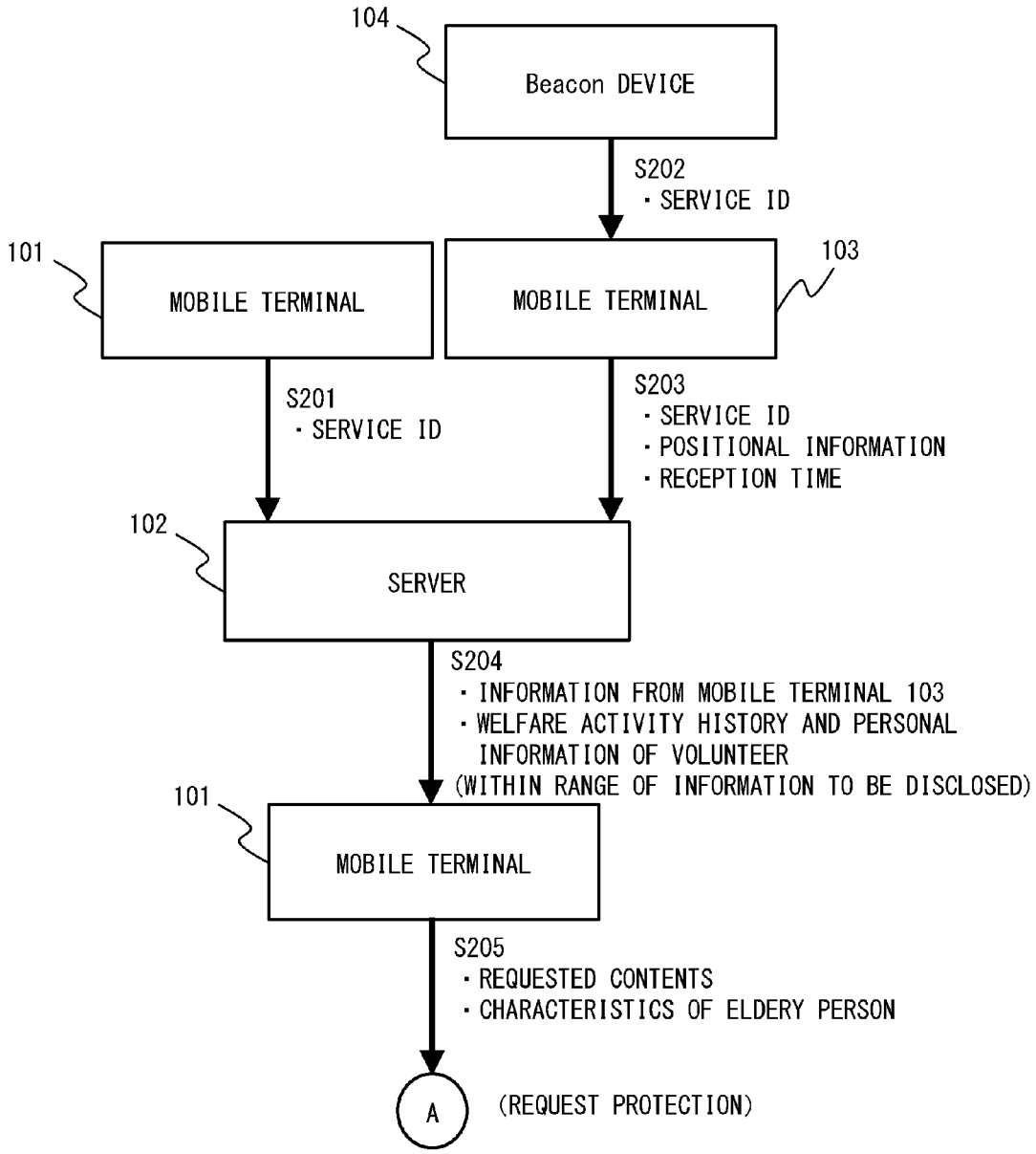
FIG. 9 is a diagram showing a data flow example of the protection support system according to the first embodiment.
Figure 10:
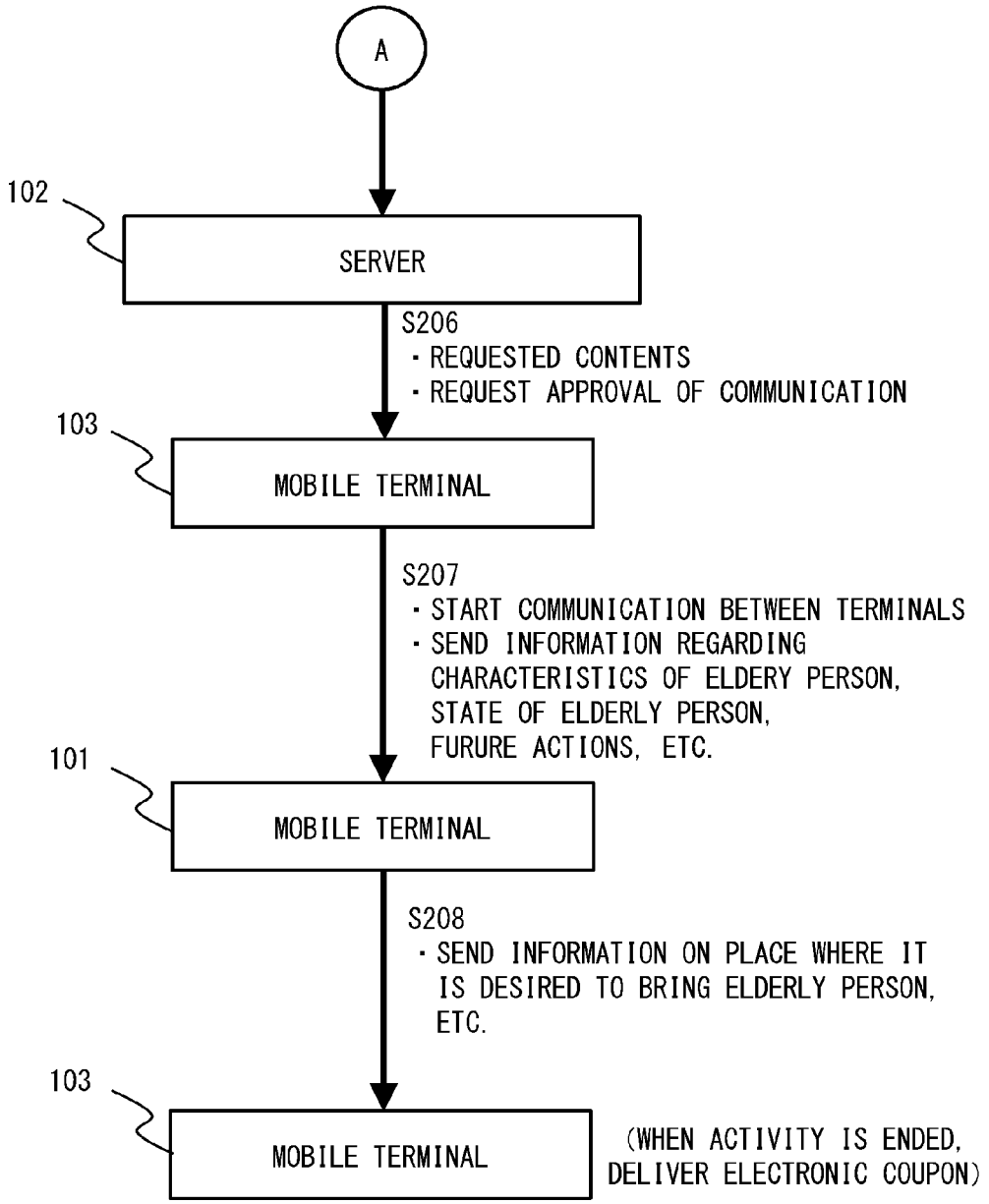
FIG. 10 is a diagram showing a data flow example of the protection support system according to the first embodiment.

Next, detailed operations of the protection support system according to this embodiment will be described. FIGS. 9 and 10 show data flow in the protection support system and FIGS. 11 to 14 show the flow of data (signals) in each device corresponding to FIGS. 9 and 10.

Figure 11:
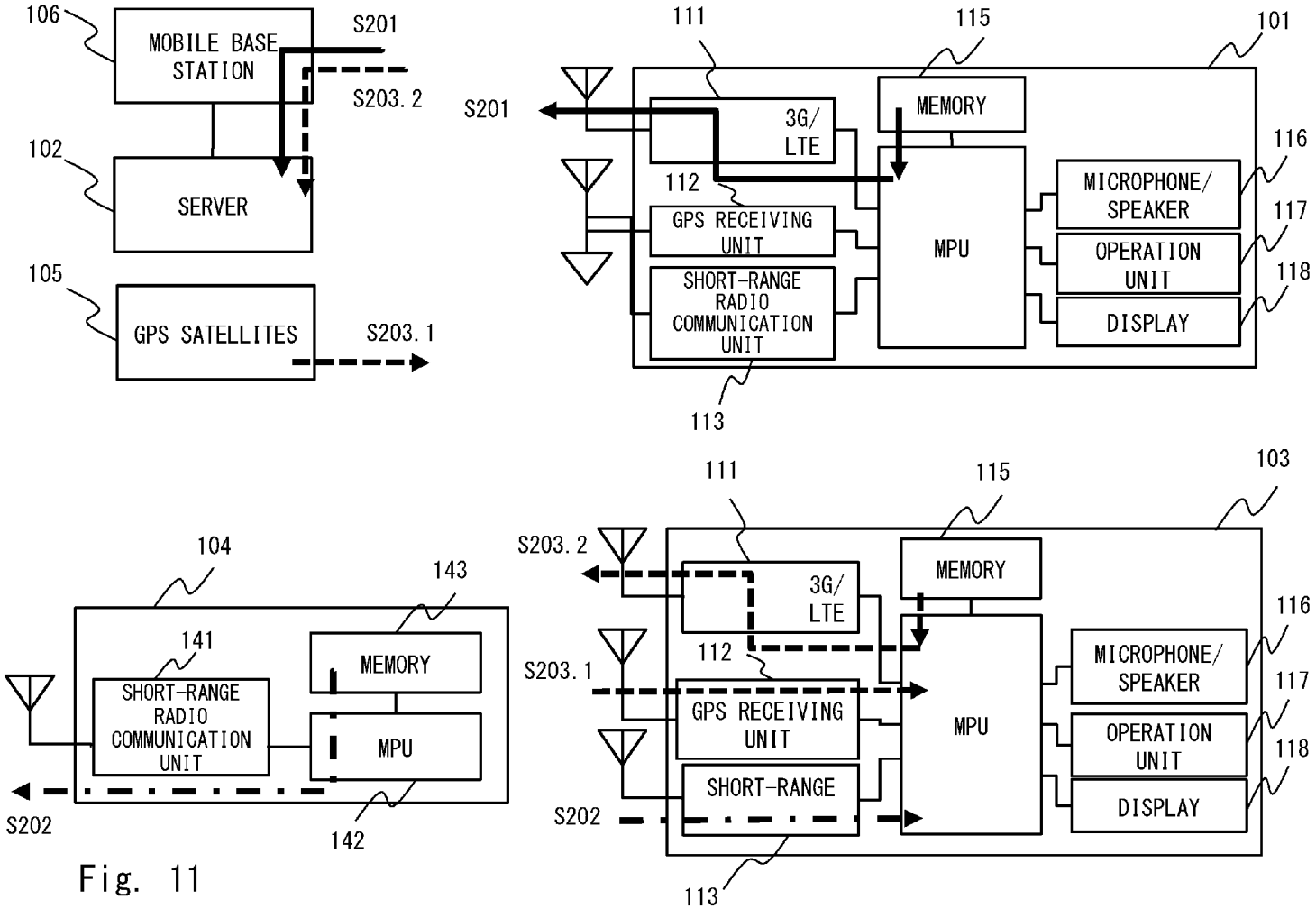
FIG. 11 is a diagram showing a data flow of the protection support system according to the first embodiment.

First, as shown in FIGS. 9 and 11, the mobile terminal 101 transmits a service ID that has been registered in the server 102 (S201). In S201, the mobile terminal 101 transmits the service ID that has been stored in the memory 115 from the 3G/LTE radio communication unit 111 according to the operation or the like by the user (requester) and the server 102 receives the service ID via the mobile base station 106. This service ID is a service ID that is stored in the beacon device held by the elderly person is asked for the protection.

Further, the beacon device 104 transmits the service ID that has been registered to the mobile terminal 103 at regular intervals (S202). In S202, the beacon device 104 transmits the beacon packet including the service ID stored in the memory 143 from the short-range radio communication unit 141 and the mobile terminal 103 receives the beacon packet including the service ID from the short-range radio communication unit 113.

Next, the mobile terminal 103 transmits the received service ID that has been registered in the past, the positional information acquired by the GPS function, and the reception time at which the service ID has been received to the server 102 (S203). The data transmission history (service ID transmission history) is stored in the server 102 as the welfare activity history. In S203, the mobile terminal 103 receives the radio waves transmitted from the GPS satellites 105 by the GPS receiving unit 112 and detects the position of the mobile terminal 103 based on the radio waves that have been received (S203.1). The mobile terminal 103 transmits the service ID, the positional information, and the time when the service ID is received stored in the memory 115 from the 3G/LTE radio communication unit 111 and the server 102 receives the service ID, the positional information, and the time when the service ID is received via the mobile base station 106 (S203.2).

Figure 12:
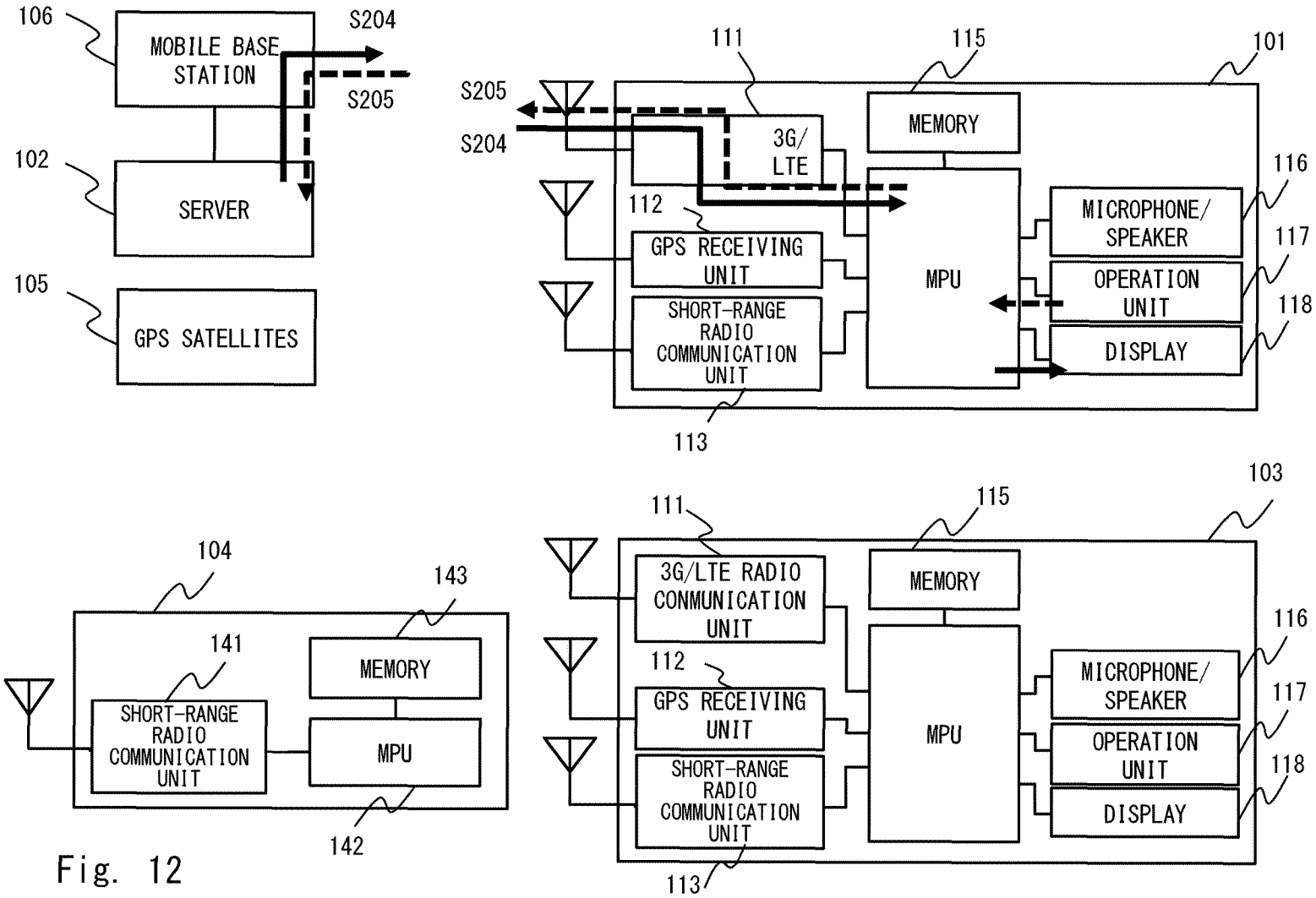
FIG. 12 is a diagram showing a data flow of the protection support system according to the first embodiment.

Next, as shown in FIGS. 9 and 12, when the received service IDs that have been registered in the past coincide with each other, the server 102 expands the information from the mobile terminal 103 to the mobile terminal 101 (S204). At this time, the server 102 transmits the personal information and the welfare activity history of the mobile terminal 103 (volunteer) to the mobile terminal 101. The configuration of the range of the information to be disclosed to the mobile terminal 101 is set by the person (volunteer) having the mobile terminal 103. The mobile terminal 103 (volunteer) sets, for example, as the disclosure configuration, that the name and the sex of the volunteer will be disclosed and the address will not be disclosed, and the server 102 transmits only the name and the sex of the volunteer to the mobile terminal 101 according to this configuration. When the service IDs received from the mobile terminals 101 and 103 coincide with each other in S204, the server 102 transmits the information received from the mobile terminal 103 (positional information, reception time), the volunteer information within the disclosure range stored in the HDD 125 (database) via the mobile base station 106, and the mobile terminal 101 receives this information by the 3G/LTE radio communication unit 111 and displays the received information on the display 118.

When the mobile terminal 101 receives the positional information and the like, the family of the elderly person may search for the elderly person having the beacon device 104 based on the positional information that has been received or may ask the mobile terminal 103 to protect the elderly person as follows using the mobile terminal 101.

That is, the mobile terminal 101 selects requested contents from the welfare activity history or the like of the mobile terminal 103 and transmits the selected contents to the server 102 (S205). For example, the mobile terminal 101 transmits the report regarding the state of the elderly person, the request to protect the elderly person until when the mobile terminal 101 arrives, or characteristics of the elderly person (physical information, name, clothes, hairstyle, etc.). In S205, when the family of the elderly person operates the operation unit 117 and selects the requested contents based on the information displayed on the display 118, the mobile terminal 101 transmits the requested contents from the 3G/LTE radio communication unit 111 and the server 102 receives the requested contents via the mobile base station 106.

Figure 13:
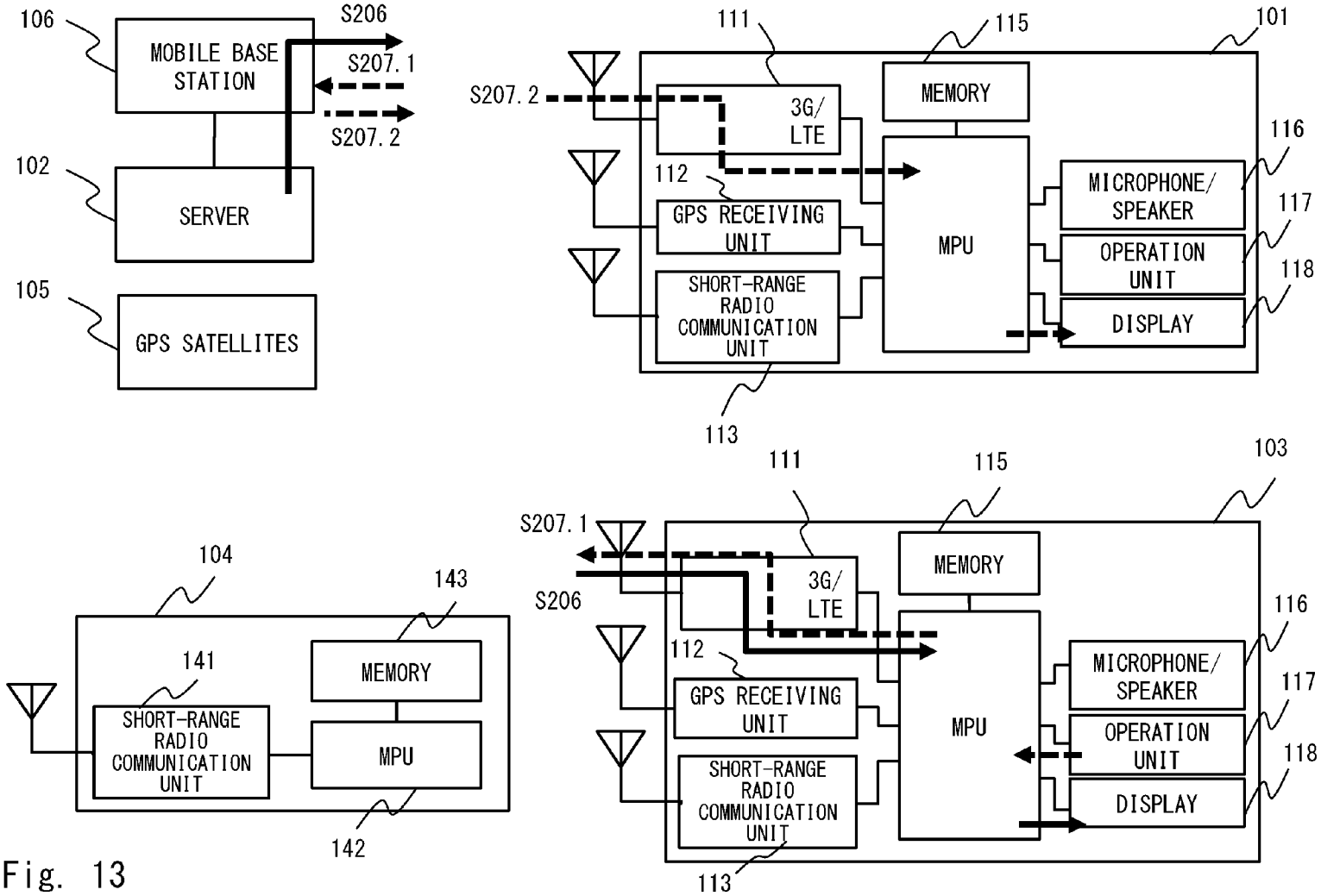
FIG. 13 is a diagram showing a data flow of the protection support system according to the first embodiment.

Next, as shown in FIGS. 10 and 13, the server 102 transmits the requested contents from the mobile terminal 101 to the mobile terminal 103 (it may include time when the service ID is received) to make an inquiry about whether to permit the communication with the mobile terminal 101 (S206). In S206, the server 102 transmits the requested contents, and the question about whether to approve the communication (it may include time when the service ID is received) via the mobile base station 106 and the mobile terminal 103 receives these information by the 3G/LTE radio communication unit 111 and displays the received information on the display 118. That is, the time when the service ID is received and the requested contents are displayed on the mobile terminal 103 and the question about whether to permit the communication with the mobile terminal 101 is displayed.

Next, when the mobile terminal 103 permits the communication, the communication between the mobile terminal 101 and the mobile terminal 103 is started (S207). According to the communication between the mobile terminal 101 and the mobile terminal 103, it is possible to definitely protect the person to be protected such as the elderly person. The communication between the terminals may be either one of a method of performing communication via the server 102 and a method of directly exchanging information by chat or the like between the mobile terminal 101 and the mobile terminal 103. An appropriate method may be selected. For example, when the family of the elderly person asks to check the state of the elderly person, information on the characteristics of the elderly person is reported to the mobile terminal 103, the elderly person located around the mobile terminal 103 is visually checked, and the state of the elderly person is sent to the mobile terminal 101. The reported information may be recorded in the server 102 as the welfare activity history. Further, the mobile terminal 103 also sends future actions to the mobile terminal 101. For example, the mobile terminal 103 sends information regarding the future plans (e.g., leave the elderly person as the volunteer is in a hurry, protect the elderly person until when the family of the elderly person arrives, take the elderly person to a predetermined place). In S207, in the mobile terminal 103, the volunteer operates the operation unit 117 based on the information displayed on the display 118. When the volunteer selects the approval of the communication, the approval of the communication is transmitted from the 3G/LTE radio communication unit 111 (S207.1), the mobile terminal 103 receives the approval of the communication via the mobile base station 106 (or the server 102) (S207.2) and the mobile terminal 101 communicates with the mobile terminal 103.

Figure 14:
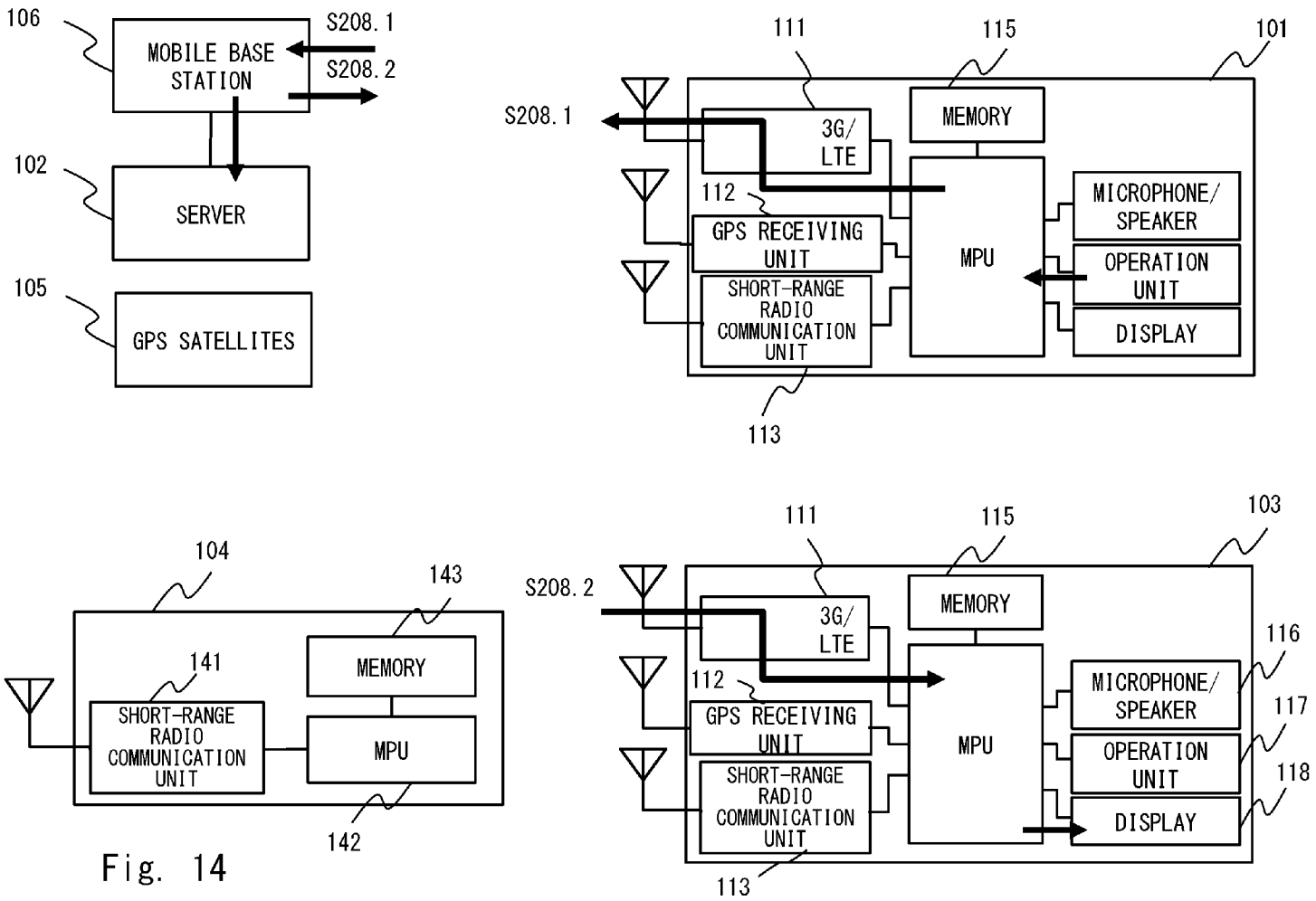
FIG. 14 is a diagram showing a data flow of the protection support system according to the first embodiment.

Next, as shown in FIGS. 10 and 14, the mobile terminal 101 transmits to the mobile terminal 103 information on a predetermined place where it is desired to bring the elderly person if it is possible to do so (S208). When the family of the elderly person can find the elderly person, the activity is ended and the server 102 records the series of activities as a welfare activity history. Further, an electronic coupon issued according to the welfare activity history is sent to the mobile terminal 103. In S208, when the family of the elderly person operates the operation unit 117 and inputs information that should be sent to the volunteer as necessary, the mobile terminal 101 transmits the information that should be sent to the volunteer from the 3G/LTE radio communication unit 111 (S208.1), the mobile terminal 103 receives the information that should be sent to the volunteer via the mobile base station 106, and then it displays the received contents on the display 118 (S208.2).

Figure 15:
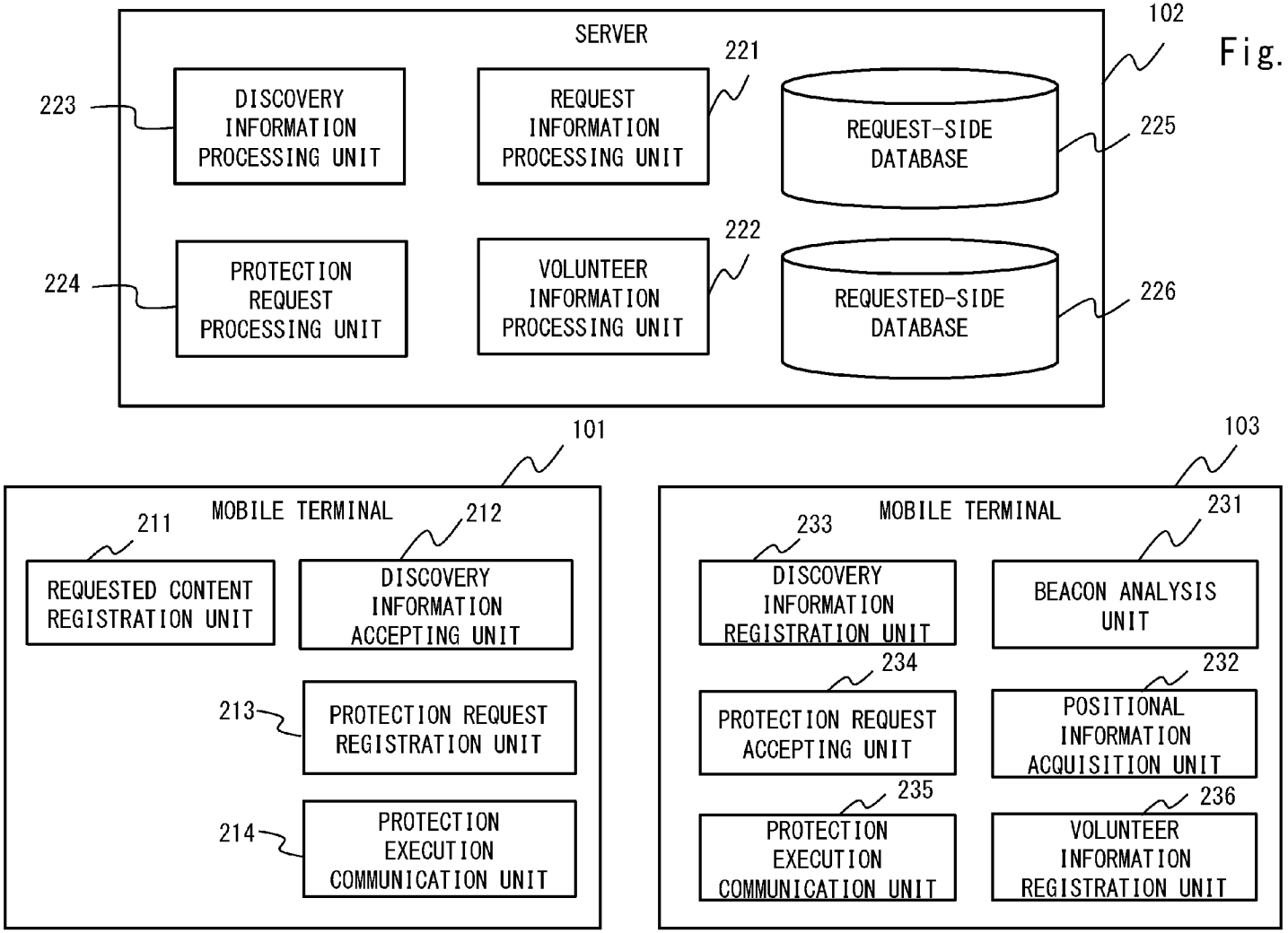
FIG. 15 is a functional block diagram showing a configuration example of the protection support system according to the first embodiment.
Figure 16:
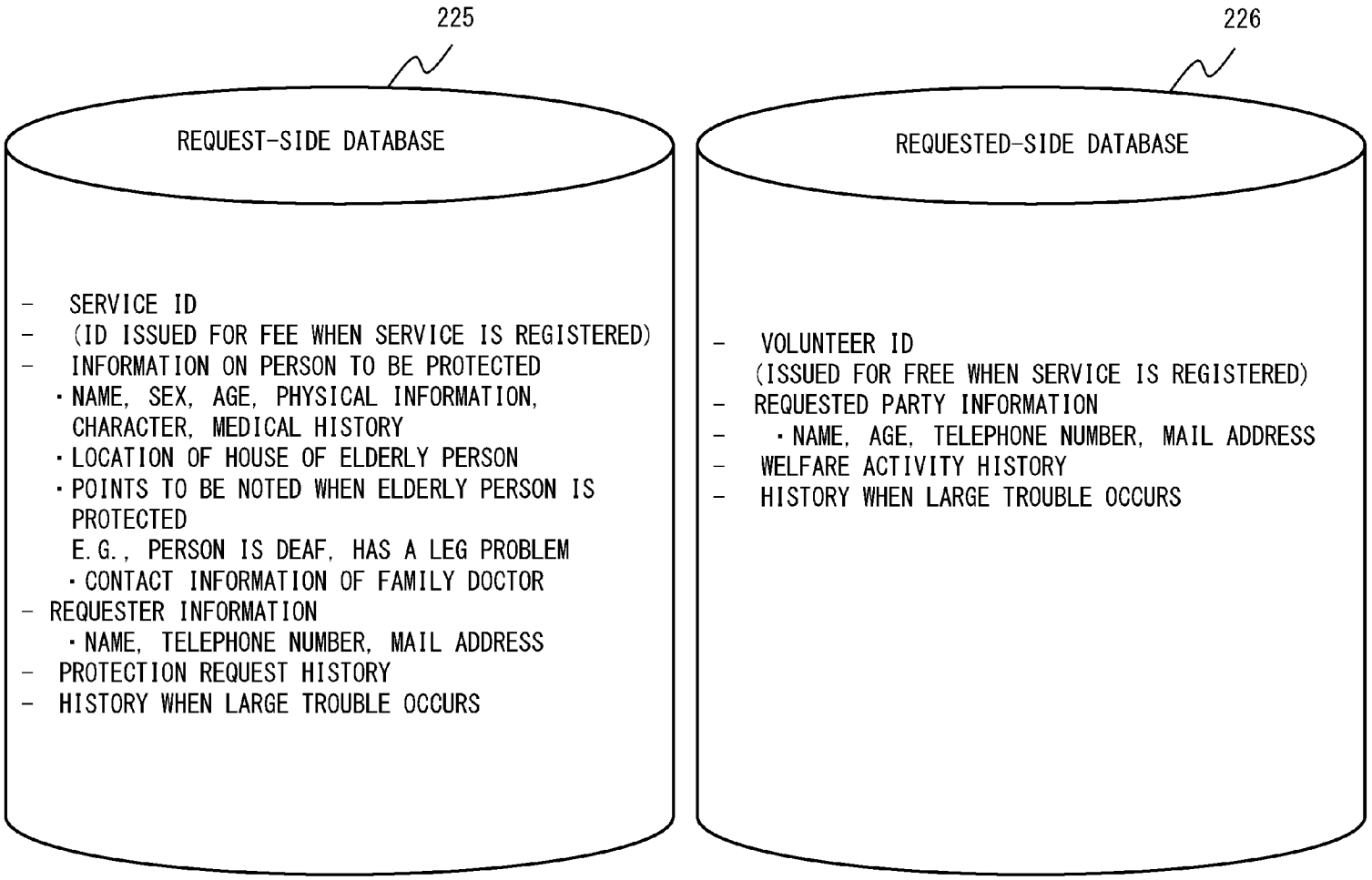
FIG. 16 is a diagram showing a configuration example of a database according to the first embodiment.
Figure 17:
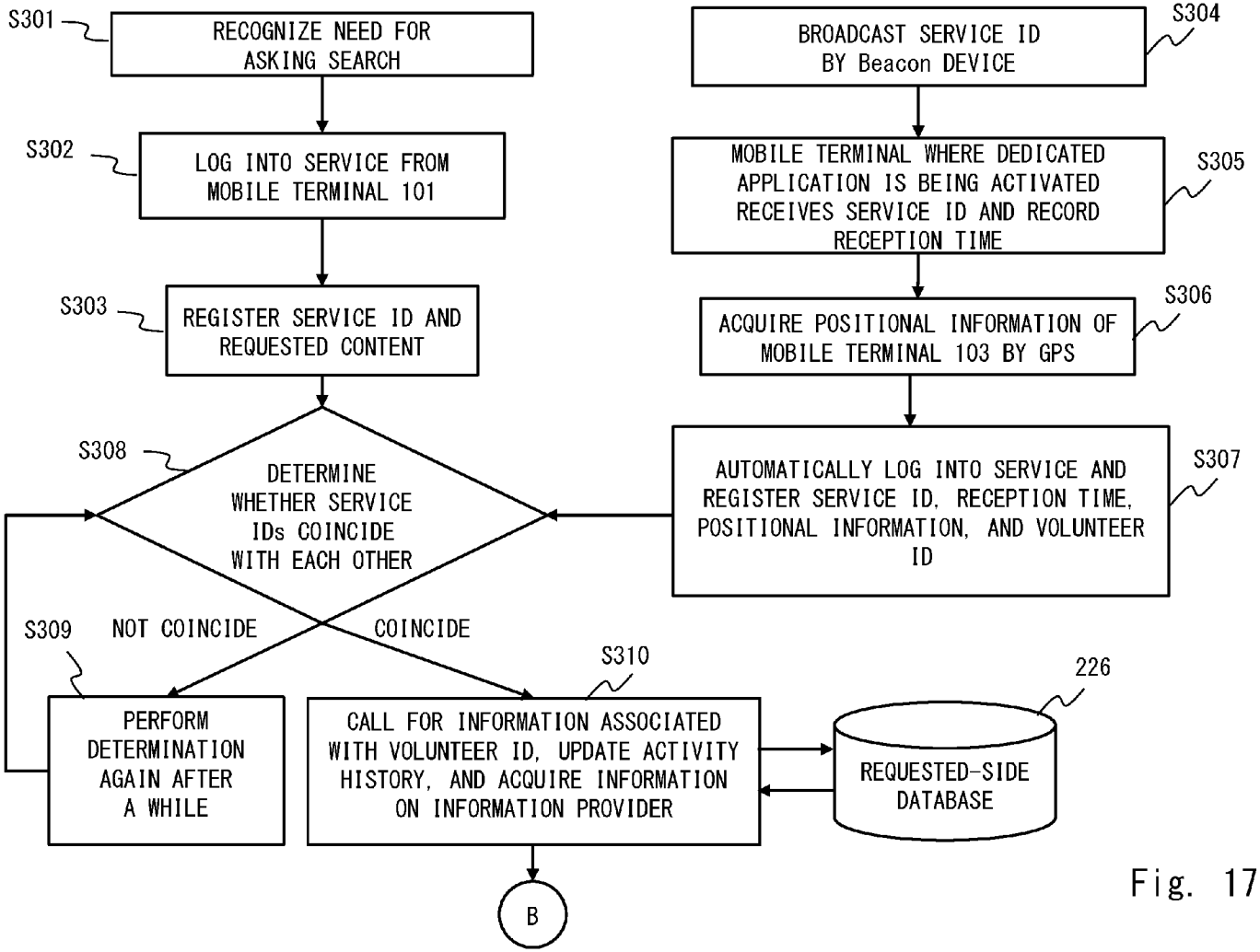
FIG. 17 is a flowchart showing an operation example of the protection support system according to the first embodiment.

Next, a specific example of the operations of the protection support system according to this embodiment will be described. FIG. 15 shows one example of the functional block used in the description of the operation, FIG. 16 shows one example of data stored in the database of the server, and FIGS. 17 to 20 are a flowchart showing an operation example. The configuration is not limited to the functional block shown in FIG. 15 and a configuration other than that shown in FIG. 15 may be employed as long as the operations shown in FIGS. 17 to 20 can be performed.

As shown in FIG. 15, the mobile terminal 103 includes a beacon analysis unit 231, a positional information acquisition unit 232, a discovery information registration unit 233, a protection request accepting unit 234, a protection execution communication unit 235, and a volunteer information registration unit 236. For example, in the mobile terminal 103, the MPU 142 executes an application program to implement the function of each element.

The beacon analysis unit (identification information receiving unit) 231 analyzes the beacon received from the beacon device 104 held by the elderly person (person to be protected) to acquire the service ID in the beacon. The positional information acquisition unit 232 acquires the positional information measured by the radio waves from the GPS satellites. The discovery information registration unit (discovery information transmitting unit) 233 registers the positional information and the service ID that have been acquired in the server 102 as the discovery information. The protection request accepting unit (the protection request demand receiving unit and the protection request demand output unit) 234 accepts the request to protect the elderly person from the server 102 and displays (outputs) the contents of the protection request that has been accepted to the volunteer or the like. The protection execution communication unit (protection communication unit) 235 communicates with the mobile terminal 101 to protect the elderly person. The volunteer information registration unit 236 registers the volunteer information regarding the volunteer in the server 102 and further sets the disclosure range of the volunteer information. Further, the volunteer information registration unit 236 may acquire a coupon or a point according to the activity history of the volunteer from the server 102.

The mobile terminal 101 includes a requested content registration unit 211, a discovery information accepting unit 212, a protection request registration unit 213, and a protection execution communication unit 214. For example, in the mobile terminal 101, the MPU 142 executes an application program to implement the function of each element.

The requested content registration unit 211 registers request information regarding the elderly person (person to be protected) or the family of the elderly person (requester) in the server 102 and further sets the disclosure range of the request information. The discovery information accepting unit (discovery information receiving unit) 212 accepts the discovery information such as the positional information of the elderly person who has been discovered from the server 102. The protection request registration unit (protection request demand transmitting unit) 213 registers the protection of the elderly person by the volunteer of the mobile terminal 101 in the server 102. The protection execution communication unit (protection communication unit) 214 communicates with the mobile terminal 103 to allow the volunteer to protect the elderly person.

The server 102 includes a request information processing unit 221, a volunteer information processing unit 222, a discovery information processing unit 223, a protection request processing unit 224, a request-side database 225, and a requested-side database 226. For example, in the server 102, the CPU 121 executes an application program (protection support program) to implement the function of each element. Further, the request-side database 225 and the requested-side database 226 are implemented by the HDD 125 and the memory 124.

The request information processing unit (request information receiving unit and configuration unit) 221 stores the request information (and the disclosure range) received from the mobile terminal 101 in the request-side database 225 and provides the request information that has been stored for the mobile terminal 103. Further, the request information processing unit (request information disclosure range determination unit) 221 determines the disclosure range (information to be disclosed) of the request information according to the instruction from the mobile terminal 101 and the disclosure range (disclosure condition) of the request information that has been set and provides the request information within the disclosure range that has been determined for the mobile terminal 103.

The volunteer information processing unit (requested information receiving unit and configuration unit) 222 stores the volunteer information (and disclosure range) received from the mobile terminal 103 in the requested-side database 226 and provides the volunteer information that has been stored for the mobile terminal 101. Further, the volunteer information processing unit (volunteer information disclosure range determination unit) 222 determines the disclosure range (information to be disclosed) of the volunteer information according to the instruction from the mobile terminal 103 and the disclosure range (disclosure condition) of the volunteer information that has been set and provides the volunteer information within the disclosure range that has been determined for the mobile terminal 101. Further, the volunteer information processing unit (coupon transmitting unit) 222 distributes (transmits) a coupon, a point or the like to the mobile terminal 103 according to the activity history of the volunteer.

The discovery information processing unit (discovery information receiving unit and transmitting unit) 223 receives the discovery information from the mobile terminal 103 and transmits the discovery information that has been received to the mobile terminal 101. The protection request processing unit (protection request demand receiving unit and transmitting unit) 224 receives the protection request (protection request demand) from the mobile terminal 101 and transmits the protection request that has been received to the mobile terminal 103.

As shown in FIG. 16, the request-side (person who makes a request) database 225 stores information (request information or request-side information) on the elderly person (person to be protected) and the family of the elderly person (requester) registered from the mobile terminal 101 and the requested-side (person who receives the request) database 226 stores information (requested party information or requested-side information) on the volunteer (information provider, who is the third party, person who actually protects the elderly person) registered from the mobile terminal 103.

The user side cannot freely browse this registration information. That is, none of the information in the request-side database 225 can be acquired unconditionally from the mobile terminal 103 and none of the information in the requested-side database 226 can be acquired from the mobile terminal 101. While it is required to present information to the counterpart user in the process of protecting the elderly person, the user can set the range of the information to be presented by him/her. There is a tradeoff relationship that, when the disclosure range is narrowed, the security level can be improved but it is impossible to gain the trust of the counterpart user. The user can therefore set the range of the information to be disclosed. The registration information may be used by a service administrator to identify the user for the purpose of improving security.

The request-side database 225 stores the service ID in association with the information regarding the person to be protected and the requester. For example, the request-side database 225 stores the service ID, the information on the person to be protected, the requester information, the protection request history, the history when large trouble occurs and the like. The disclosure range (disclosure condition and whether to disclose the information) is set for each of the pieces of the information (or further detailed information). For example, the server 102 (disclosure range determination unit) determines the information selected from the information on the person to be protected and the requester information to be the information to be disclosed. The requester information is disclosed when it is required to at least contact the requester and the information on the person to be protected is disclosed when it is required to protect the person to be protected. In this way, only the necessary information can be disclosed.

For example, the service ID is an ID issued for a fee when the service is registered. The information on the person to be protected includes the name, the sex, the age, physical information, character, medical history of the person to be protected (elderly person), the location of the house of the elderly person, points to be noted when the elderly person is protected, contact information of the family doctor and the like. Among the information on the person to be protected, only the sex, the age, and the physical information (external characteristics) may be disclosed and the name and the like that can specify the individual may not be disclosed. The points to be noted when the elderly person is protected include that the person is deaf, has a leg problem or the like. The requester information includes the name, the telephone number, the mail address or the like of the requester (family of the elderly person).

The requested-side database 226 stores a volunteer ID in association with the information on the volunteer. For example, the requested-side database 226 stores the volunteer ID, the requested party information, the welfare activity history, the history when large troubles occur and the like. The disclosure range (disclosure condition and whether to disclose the information) is set for each of these pieces of information (or further detailed information).

For example, the volunteer ID is an ID issued for free when the service is registered. The requested party information includes the name, the age, the telephone number, the mail address and the like of the requested party (volunteer).

As shown in FIGS. 17 to 20, first, the family of the elderly person (requester) recognizes the need for asking the search for the elderly person (S301), logs into the service (server 102) from the mobile terminal 101 (communication terminal/PC) (S302), and registers the service ID and the requested content (S303). The requested content registration unit 211 of the mobile terminal 101 logs into the server 102 according to the operation by the family of the elderly person and transmits the service ID, the information on the person to be protected, and the requester information to the request information processing unit 221 of the server 102, and the request information processing unit 221 registers the service ID, the information on the person to be protected, and the requester information that have been received in the request-side database 225. At this time, the mobile terminal 101 may set the disclosure range of the information to be registered.

Further, when the beacon device 104 (short-range wireless device such as Bluetooth) broadcasts the service ID (beacon packet) (S304), the mobile terminal 103 (communication terminal) where a dedicated application is being activated receives the service ID and records the reception time (S305). The beacon analysis unit 231 of the mobile terminal 103 analyzes the beacon packet received from the beacon device 104, acquires the service ID, and records the reception time in the memory. For example, when the mobile terminal 103 receives the beacon packet from the beacon device 104, the mobile terminal 103 may light up an LED of the mobile terminal 103, emit sound from a speaker, or operate a vibrator.

Further, the mobile terminal 103 acquires the positional information of the mobile terminal 103 (communication terminal) by the GPS (S306), automatically logs into the service (server 102), and registers the service ID, the reception time, the positional information, and the volunteer ID (S307). The positional information acquisition unit 232 of the mobile terminal 103 acquires the positional information (or calculates the positional information) obtained based on the radio waves from the GPS satellites. The discovery information registration unit 233 of the mobile terminal 103 logs into the server 102 and transmits the service ID that has been received, the reception time, the positional information that has been received, and the volunteer ID stored in (or input to) the memory. In S304 to S307 or in the previous step, the volunteer information registration unit 236 of the mobile terminal 103 may register the volunteer information in the server 201 according to the operation by the volunteer and the disclosure range of the information to be registered may be set.

Next, the server 102 determines whether the service IDs received from the mobile terminals 101 and 103 coincide with each other (S308). When the service IDs do not coincide with each other, the server 102 performs the determination again after a while (S309). When the service IDs coincide with each other, the server 102 calls for the information associated with the volunteer ID, updates the activity history, and acquires information on the information provider (volunteer information) (S310). The discovery information processing unit 223 of the server 102 compares the service ID received from the mobile terminal 103 with the service ID of the request-side database 225 registered from the mobile terminal 101. When the service IDs coincide with each other, the volunteer information processing unit 222 refers to the information related to the volunteer ID received from the requested-side database 226, updates the corresponding activity history of the volunteer, and acquires the volunteer information.

Next, the server 102 notifies the person who has made the request for the search (mobile terminal 101) of the reception time and the positional information (S311), and the mobile terminal 101 acquires the reception time and the positional information (S312). The discovery information processing unit 223 of the server 102 transmits the reception time and the positional information received from the mobile terminal 103 to the mobile terminal 101 and the discovery information accepting unit 212 of the mobile terminal 101 receives the reception time and the positional information from the server 102.

Next, it is determined whether the person who has made the request for the search (mobile terminal 101) requests the information provider (volunteer) to work together (S313). When the person who has made the request for the search (mobile terminal 101) does not request the information provider (volunteer) to work together, the person who has made the request for the search goes to the location indicated by the positional information that has been received to search for the person to be protected (elderly person) (S314). When the person who has made the request for the search requests the information provider (volunteer) to work together, the mobile terminal 101 acquires the information on the information provider (volunteer) within the disclosure range set by the information provider (volunteer) in advance (S315). For example, the age, the sex, the activity history, and the history of trouble or the like of the volunteer that have been set to be disclosed are disclosed. The protection request registration unit 213 of the mobile terminal 101 may acquire information on the corresponding volunteer from the requested-side database 226 of the server 102, for example. Alternatively, the protection request registration unit 213 may acquire the volunteer ID when it acquires the reception time and the positional information from the server 102 and acquire the information on the corresponding volunteer from the requested-side database 226 based on this volunteer ID. Further, the protection request registration unit 213 may acquire the information on the volunteer from the server 102 when it acquires the reception time and the positional information from the server 102.

Next, it is determined whether the person who has made the request for the search (mobile terminal 101) requests the information provider (volunteer) to work together (S316). When the person who has made the request for the search does not request the information provider (volunteer) to work together, the person who has made the request for the search goes to the place indicated by the positional information that has been received to search for the person to be protected (elderly person) (S317). When the person who has made the request for the search requests the information provider (volunteer) to work together, the mobile terminal 101 logs into the service (server 102), registers the details of the activity, and asks for the contact to the information provider (volunteer) (S318). The protection request registration unit 213 of the mobile terminal 101 determines whether the volunteer is a reliable person based on the information on the volunteer that has been received. When it is determined that the volunteer is a reliable person, the protection request registration unit 213 logs into the server 102 and transmits the contents of the protection and the communication request between the mobile terminals 101 and 103.

Next, after the server 102 has collected the information on the person who has made the request, the server 102 sends a request for cooperation to the information provider (mobile terminal 103) (S319) and the mobile terminal 103 receives the request for cooperation from the server 102 (S320). Upon receiving the protection request and the communication request between terminals from the mobile terminal 101, the protection request processing unit 224 of the server 102 acquires the requester information (name, telephone number, mail address etc.) from the request-side database 225 and then transmits the contents of the protection request that have been received to the mobile terminal 103.

Next, the mobile terminal 103 acquires the requester information within the disclosure range set by the person who has made the request for the search (mobile terminal 101) in advance (S321). For example, the mobile terminal 103 acquires the information regarding the state of the elderly person, the requested contents and the like that is set to be disclosed. Upon receiving the protection request from the server 102, the protection request accepting unit 234 of the mobile terminal 103 may acquire the corresponding requester information based on the service ID from the request-side database 225 of the server 102 or acquire the requester information when it receives the protection request from the server 102, for example.

Next, the mobile terminal 103 determines whether to respond to the request for cooperation based on the information input by the information provider (volunteer) (S322). When the mobile terminal 103 works together, it starts exchanging information with the requester (mobile terminal 101) (S323). For example, in the communication between the mobile terminal 101 and the mobile terminal 103, when the mobile terminal 103 answers the question (health and mental states of the person to be protected) from the requester (mobile terminal 101), the mobile terminal 101 receives the answer and requests further activities (S324). When the protection request accepting unit 234 of the mobile terminal 103 responds to the mobile terminal 101 that it will work together to protect the elderly person and permit communication with the mobile terminal 101 according to the operation by the volunteer, communication is started between the protection execution communication unit 214 of the mobile terminal 101 and the protection execution communication unit 235 of the mobile terminal 103 and information necessary for the protection is exchanged.

Further (as necessary), since the mobile terminal 101 requests changes of the registration information of the system (server 102) (S325) and the server 102 updates the configuration of the request-side database 225 according to the request (S326). For example, the server 102 changes the configuration to allow only the information provider (volunteer) to browse more detailed information such as the character of the elderly person, the points to be noted when the information provider (volunteer) speaks to the elderly person, and the address of the house. Next, the information provider (volunteer) executes the request (protection) from the requester by reference to the information on the elderly person acquired from the system (server 102) (S327).

When it is determined in S322 that the mobile terminal 103 does not respond to the request to work together with the person who has made the request or the information provider (volunteer) executes the request and completes the volunteer activities in S327 (S328), the server 102 updates the activity history in the requester side and the information provider side according to the contents of the activity (S329). The request information processing unit 221 of the server 102 acquires the protection request history from the mobile terminal 101 and updates the request-side database 225, and the volunteer information processing unit 222 of the server 102 acquires the volunteer activity history from the mobile terminal 103 and updates the requested-side database 226.

As described above, in this embodiment, the beacon device of the short-range wireless communication (Bluetooth LE) is held by the person to be protected such as the elderly person as an electronic identification tag and the third party such as the volunteer can find the person to be protected from the beacon (iBeacon) from the beacon device. Since the beacon device consumes low power, the battery life is as long as about one year and it is thus possible to reduce the operation of charging.

Further, since the beacon from such a beacon device can be received by a typical smartphone or the like, it is sufficient to only install the application into the smartphone to use the system according to this embodiment. Since a widely used terminal such as a smartphone can be used, even when the elderly person with dementia is wandering around a region which the family of the elderly person is not familiar with, it is highly possible to find the elderly person and to have a volunteer or the like definitely protect the elderly person.

Further, when the identification ID is broadcasted by the beacon device, it is difficult to know what kind of recipients and how many recipients received the information. Therefore, the necessary information is acquired by the access to the server and the positional information of the elderly person who is wandering around cannot be directly acquired from the identification ID in each terminal. In particular, a plurality of pieces of personal information regarding the elderly person may be acquired. Therefore, the information can be acquired only within the range allowed by the family of the elderly person. It is therefore possible to protect privacy and to ensure security. Further, the logs of the information acquisition and the protection activities are kept and are used to determine whether the volunteer is a reliable person. It is therefore possible to safely protect the elderly person. Further, since the disclosure range of the information on the volunteer can also be set, it is also possible to protect privacy of the volunteer.

Further, in this embodiment, in order to protect the elderly person by the volunteer, it is required to efficiently use the volunteer. Therefore, by distributing a coupon to the volunteer who worked together to protect the elderly person to visualize the welfare activity history, it is possible to improve the motivation of the volunteer.

Second Embodiment

Hereinafter, with reference to the drawings, a second embodiment will be described. In this embodiment, an operation example of a case in which it takes time to access the service for asking for the search after the requester notices the absence of the person to be searched and there are a plurality of information providers will be described. The configuration of the protection support system according to this embodiment is similar to that in the first embodiment.

The server 102 (protection request processing unit) transmits a protection request based on the positional information received from the mobile terminal 103. By sending the protection request to the mobile terminal 103 that has been selected based on the positional information of the plurality of mobile terminals 103, it can request the optimal mobile terminal 103 which is close to the person to be protected to perform the protection. Further, the mobile terminal 103 (beacon analysis unit) is able to detect the distance from the mobile terminal 103 to the beacon device upon receiving the beacon. Therefore, the mobile terminal 103 (discovery information registration unit) may transmit the distance with the identification information and the server 102 (protection request processing unit) may transmit the protection request based on the distance received from the mobile terminal 103. By sending the protection request to the mobile terminal 103 that has been selected based on the distance from the plurality of mobile terminals 103 to the beacon device, it can request the optimal mobile terminal 103 which is close to the person to be protected to perform the protection. The mobile terminal 101 (requester) may select the mobile terminal 103 (requested party) based on the information received by the mobile terminal 101 (requester) from the server or the server 102 may select the mobile terminal 103 (requested party) based on the positional information or the distance.

Figure 18:
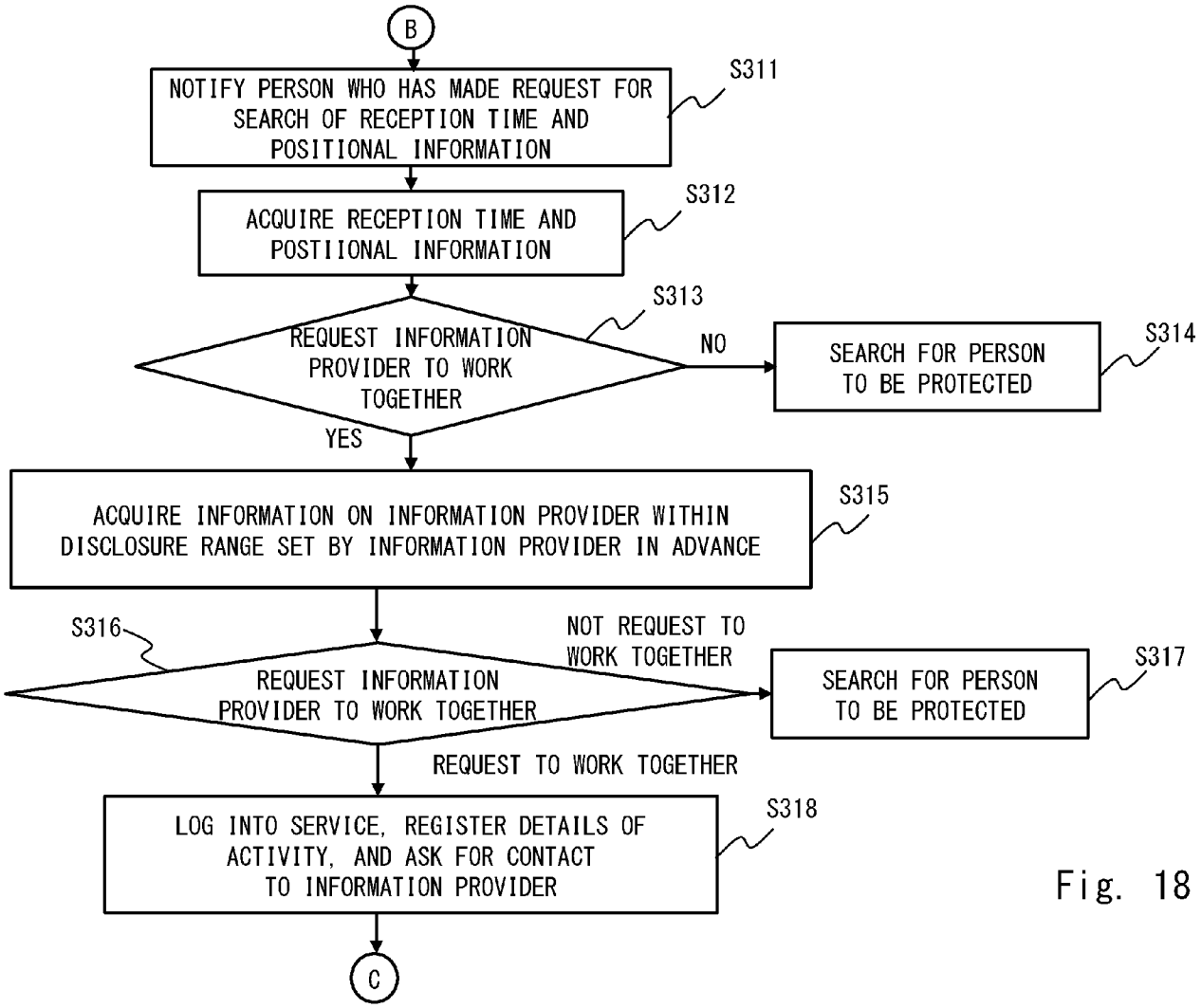
FIG. 18 is a flowchart showing an operation example of the protection support system according to the first embodiment.
Figure 19:
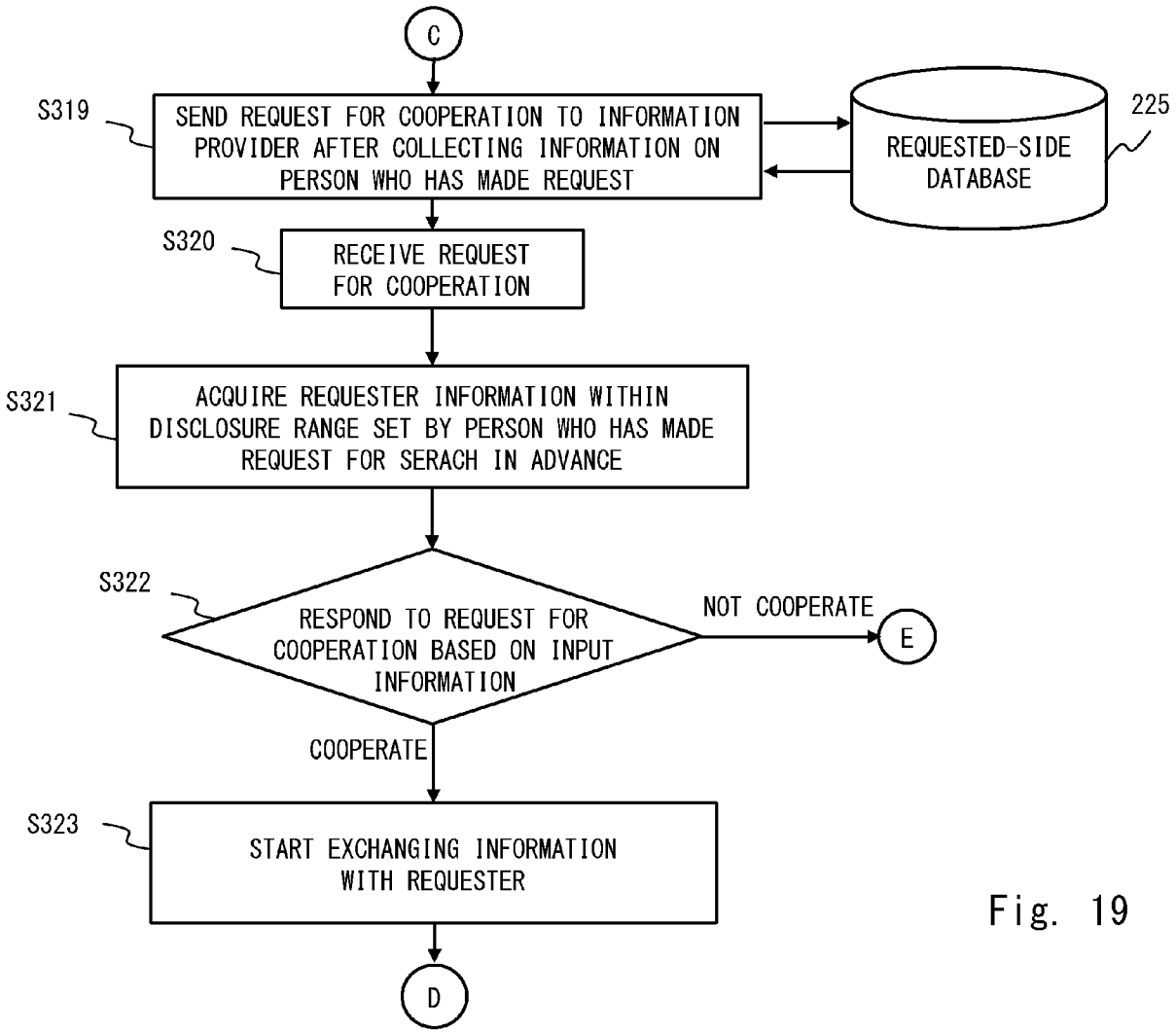
FIG. 19 is a flowchart showing an operation example of the protection support system according to the first embodiment.
Figure 20:
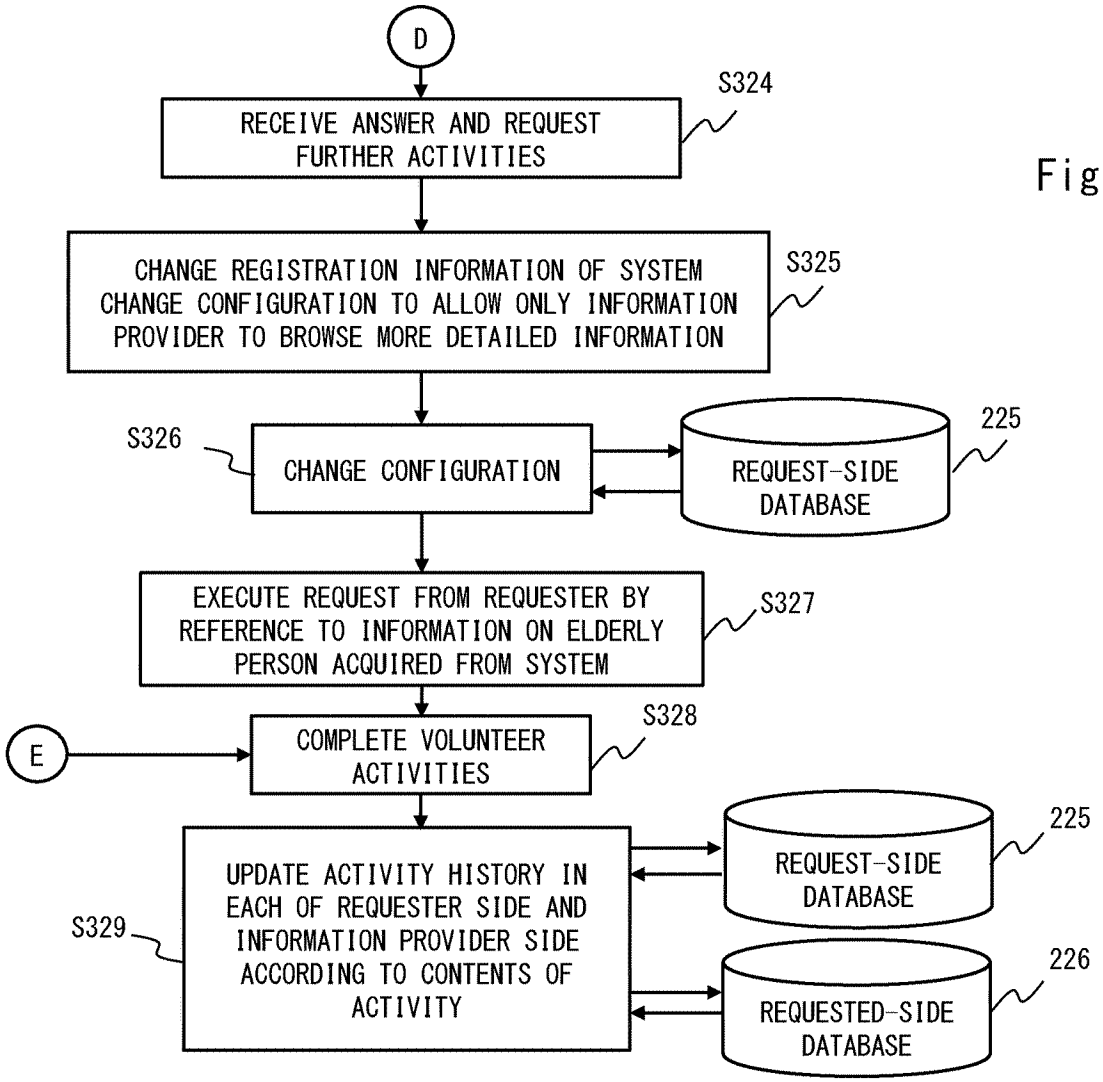
FIG. 20 is a flowchart showing an operation example of the protection support system according to the first embodiment.
Figure 21:
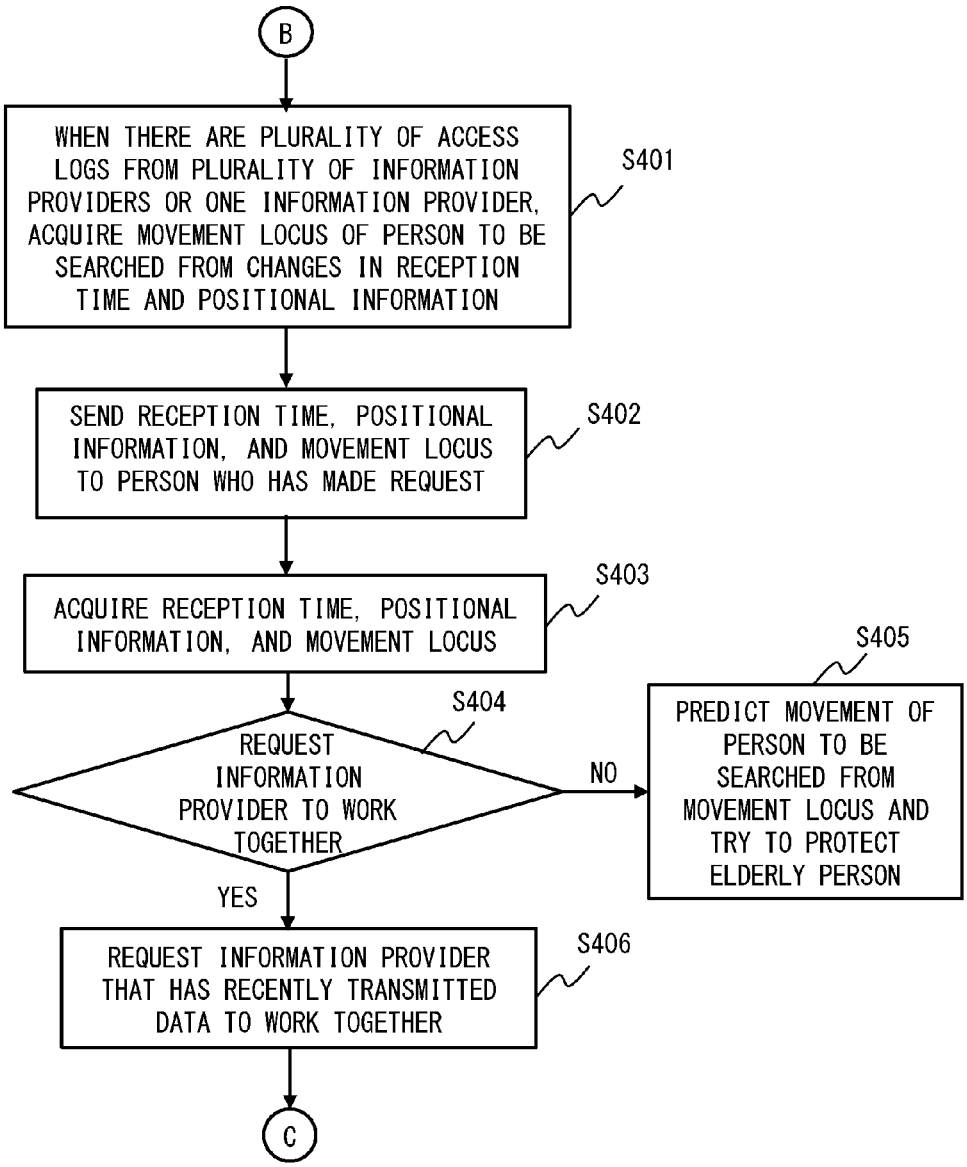
FIG. 21 is a flowchart showing an operation example of a protection support system according to a second embodiment.

FIG. 18 is a flowchart showing an operation according to this embodiment. S301 to S310 are similar to the steps shown in FIG. 17 according to the first embodiment. After S310, when there are a plurality of access logs from a plurality of information providers or one information provider, the server 102 acquires the movement locus of the person to be searched from the changes in the reception time and the positional information (S401). Next, the server 102 sends the reception time, the positional information, and the movement locus to the person who has made the request for the search (S402) and the mobile terminal 101 acquires the reception time, the positional information, and the movement locus (S403).

Next, it is determined whether the person who has made the request for the search requests the information provider to work together (S404). When the person who has made the request for the search does not request the information provider to work together, the person who has made the request for the search predicts the movement of the person to be searched from the movement locus and tries to protect the elderly person (S405). On the other hand, when the person who has made the request for the search requests the information provider to work together, the mobile terminal 101 requests the information provider that has recently transmitted data to work together (S406). The following processing is similar to that of the first embodiment. The mobile terminal 101 (requester) may select the mobile terminal 103 (requested party) based on the information received by the mobile terminal 101 (requester) from the server based on the reception time or the server 102 may select the mobile terminal 103 (requested party) based on the reception time.

As stated above, the server 102 (protection request processing unit) may transmit the protection request based on the reception time received from the mobile terminal 103. By requesting the mobile terminal 103 that has been selected to perform protection based on the reception time of the plurality of mobile terminals 103, it is possible to request the optimal mobile terminal 103 to perform the protection since the mobile terminal 103 that has recently transmitted data is probably close to the person to be protected.

Further, the program to achieve the embodiments stated above can be stored and provided to a computer using any type of non-transitory computer readable media. Non-transitory computer readable media include any type of tangible storage media. Examples of non-transitory computer readable media include magnetic storage media (such as flexible disks, magnetic tapes, hard disk drives, etc.), optical magnetic storage media (e.g., magneto-optical disks), Compact Disc Read Only Memory (CD-ROM), CD-R, CD-R/W, and semiconductor memories (such as mask ROM, Programmable ROM (PROM), Erasable PROM (EPROM), flash ROM, Random Access Memory (RAM), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g., electric wires, and optical fibers) or a wireless communication line.

While the invention made by the present inventors has been specifically described based on the embodiments, it is needless to say that the present invention is not limited to the embodiments already stated above and various changes may be made on the embodiments without departing from the spirit of the present invention.

The first and second embodiments can be combined as desirable by one of ordinary skill in the art.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A protection support system comprising a protection terminal and a protection support server, wherein:

the protection terminal comprises:

an identification information receiving unit that receives identification information from a transmitter held by a person to be protected; and a discovery information transmitting unit that transmits discovery information including the identification information that has been received to the protection support server, the protection support server comprises:

a discovery information receiving unit that receives the discovery information transmitted from the protective terminal;

a request-side information storage unit that stores request-side information in which information on the person to be protected and the identification information regarding the person to be protected are associated with each other;

a disclosure range determination unit that determines a disclosure range of the request-side information corresponding to the identification information included in the discovery information that has been received; and a protection request demand transmitting unit that transmits a protection request demand including request-side information within the disclosure range that has been determined to the protection terminal, and the protection terminal further comprises:

a protection request demand receiving unit that receives a protection request demand including the request-side information within the disclosure range from the protection support server; and a protection request demand output unit that outputs the protection request demand that has been received to a requested party who protects the person to be protected, wherein:

the protection terminal comprises a positional information acquisition unit that acquires positional information of the protection terminal, the discovery information transmitting unit transmits the discovery information including the positional information that has been acquired and the identification information, and the protection request demand transmitting unit transmits the protection request demand based on the positional information included in the discovery information.

2. The protection support system according to claim 1, comprising a plurality of protection terminals, wherein the protection request demand transmitting unit transmits the protection request demand to a protection terminal selected from the plurality of protection terminals based on the positional information.

3. A protection support system comprising a protection terminal and a protection support server, wherein:

the protection terminal comprises:

an identification information receiving unit that receives identification information from a transmitter held by a person to be protected; and a discovery information transmitting unit that transmits discovery information including the identification information that has been received to the protection support server, the protection support server comprises:

a discovery information receiving unit that receives the discovery information transmitted from the protective terminal;

a request-side information storage unit that stores request-side information in which information on the person to be protected and the identification information regarding the person to be protected are associated with each other;

a disclosure range determination unit that determines a disclosure range of the request-side information corresponding to the identification information included in the discovery information that has been received; and a protection request demand transmitting unit that transmits a protection request demand including request-side information within the disclosure range that has been determined to the protection terminal, and the protection terminal further comprises:

a protection request demand receiving unit that receives a protection request demand including the request-side information within the disclosure range from the protection support server; and a protection request demand output unit that outputs the protection request demand that has been received to a requested party who protects the person to be protected, wherein:

the protection terminal comprises a distance detection unit that detects a distance from the transmitter to the protection terminal, the discovery information transmitting unit transmits discovery information including the distance that has been detected and the identification information, and the protection request demand transmitting unit transmits the protection request demand based on the distance included in the discovery information.

4. The protection support system according to claim 3, comprising a plurality of protection terminals, wherein the protection request demand transmitting unit transmits the protection request demand to a protection terminal selected from the plurality of protection terminals based on the distance from the transmitter to the protection terminal.

5. A protection support system comprising a protection terminal and a protection support server, wherein:

the protection terminal comprises:

an identification information receiving unit that receives identification information from a transmitter held by a person to be protected; and a discovery information transmitting unit that transmits discovery information including the identification information that has been received to the protection support server, the protection support server comprises:

a discovery information receiving unit that receives the discovery information transmitted from the protective terminal;

a request-side information storage unit that stores request-side information in which information on the person to be protected and the identification information regarding the person to be protected are associated with each other;

a disclosure range determination unit that determines a disclosure range of the request-side information corresponding to the identification information included in the discovery information that has been received; and a protection request demand transmitting unit that transmits a protection request demand including request-side information within the disclosure range that has been determined to the protection terminal, and the protection terminal further comprises:

a protection request demand receiving unit that receives a protection request demand including the request-side information within the disclosure range from the protection support server; and a protection request demand output unit that outputs the protection request demand that has been received to a requested party who protects the person to be protected, wherein:

the discovery information transmitting unit transmits the discovery information including a reception time at which the identification information has been received and the identification information, and the protection request demand transmitting unit transmits the protection request demand based on the reception time included in the discovery information.

6. The protection support system according to claim 5, comprising a plurality of protection terminals, wherein the protection request demand transmitting unit transmits the protection request demand to a protection terminal selected from the plurality of protection terminals based on the reception time at which the identification information has been received.

* * * * *